US007543926B2

(12) United States Patent
Lacroix

(10) Patent No.: US 7,543,926 B2
(45) Date of Patent: Jun. 9, 2009

(54) PROCESS FOR PRINTING TEXTILE FIBRE MATERIALS IN ACCORDANCE WITH THE INK-JET PRINTING PROCESS

(75) Inventor: Roger Lacroix, Rue Vauban (FR)

(73) Assignee: Huntsman International LLC, The Woodlands, TX (US)

( * ) Notice: Subject to any disclaimer, the term of this patent is extended or adjusted under 35 U.S.C. 154(b) by 498 days.

(21) Appl. No.: 10/554,575

(22) PCT Filed: Apr. 21, 2004

(86) PCT No.: PCT/EP2004/050571

§ 371 (c)(1),
(2), (4) Date: Oct. 26, 2005

(87) PCT Pub. No.: WO2004/097105

PCT Pub. Date: Nov. 11, 2004

(65) Prior Publication Data

US 2006/0260507 A1 Nov. 23, 2006

(30) Foreign Application Priority Data

Apr. 30, 2003 (EP) ..... 03405302

(51) Int. Cl.
*G01D 11/00* (2006.01)

(52) U.S. Cl. ..... 347/100; 347/95; 347/101

(58) Field of Classification Search ..... 347/100, 347/95, 96, 101, 105; 106/31.6, 31.27, 31.13; 523/160

See application file for complete search history.

(56) References Cited

U.S. PATENT DOCUMENTS

| | | | | |
|---|---|---|---|---|
| 4,849,770 | A | 7/1989 | Koike et al. | 346/1.1 |
| 5,358,558 | A | 10/1994 | Yamamoto et al. | 106/31.47 |
| 5,940,099 | A | 8/1999 | Karlinski | 347/70 |
| 6,086,636 | A | 7/2000 | Mheidle et al. | 8/445 |
| 6,345,879 | B1 | 2/2002 | Fisher | 347/40 |
| 6,350,011 | B1 | 2/2002 | Karlinski | 347/40 |
| 6,439,702 | B1 | 8/2002 | Karlinski | 347/70 |
| 6,481,074 | B1 | 11/2002 | Karlinski | 29/25.35 |
| 6,543,869 | B2 | 4/2003 | Irizawa et al. | 347/14 |

FOREIGN PATENT DOCUMENTS

| | | |
|---|---|---|
| EP | 0 534 428 | 3/1993 |
| EP | 0 924 085 | 6/1999 |
| WO | 01/30577 | 5/2001 |

*Primary Examiner*—Manish S Shah

(57) ABSTRACT

An ink-jet printing process for printing textile fiber materials, wherein the fiber materials are printed with an aqueous ink including (I) at least one fiber reactive dye, and (II) a di, tri or tetramer of a C2-C4-oxyalkylene or a mono- or di-C1-C4-alkyl ether of a di, tri or tetramer of a C2-C4-oxyalkylene, said ink having a viscosity from 5 to 20 mPas at 25° C., and wherein the said ink is applied to the fiber material with an ink-jet print head having an ink supply layer (b) receiving ink from an external ink reservoir, said ink supply layer having a first side and a second side and including, a porous medium having a plurality of pores therein and a plurality of holes extending therethrough, so as to allow passage of the ink allows for high speed printing and yields prints with good fastness properties.

15 Claims, No Drawings

PROCESS FOR PRINTING TEXTILE FIBRE MATERIALS IN ACCORDANCE WITH THE INK-JET PRINTING PROCESS

The present invention relates to a process for printing textile fibre materials using reactive dyes in accordance with the inkjet printing process and to corresponding printing inks.

Rotary and flat-screen printing are presently prevailing as textile printing methods. However, these conventional methods are not profitable unless the quantity of the product is sufficiently large. In addition, since the fashion of the print pattern changes rapidly, there is a risk in that a large quantity of the printed products are not sold but kept in stock when production cannot follow the rapid change in the fashion. Accordingly, there is a demand for establishing electronic textile printing systems, such as inkjet, that require no printing plates and are suited for multi-item and small-quantity production and respond to fashion rapidly.

Ink-jet printing technology opens up new design capabilities around colors, patterns and images. The ability to change colors and designs quickly is one of the major advantages of ink-jet printing over rotary traditional screen-printing methods. In a digital system, design changes are enabled through software, without needing to engrave screens. Color changes are also made at the computer, eliminating the process of cleaning screens and changing inks. Actual fabric samples of new designs are possible at a fraction of the cost and in a fraction of the time formerly needed. By this way designers and textile and apparel companies can interact to bring new products to market almost instantaneously. Instantaneous data transfer over the global Internet and similar data exchange via local area networks (LANs) make it possible to exchange ideas faster than ever.

Despite the many advantages, inkjet still suffers from some drawbacks, some of which become even more pronounced when print speed is increasing. Hardware reliability (e.g. clogged nozzles) and speed limitations are technical barriers limiting the use of ink-jet printing primarily to generation of samples. State of the art inkjet textile printers are capable of printing 2 to 30 $m^2/h$ operating at a frequency of 2 to 8 KHz. In order to become a true production method both for short runs and for sampling, ink-jet processes are required which are reliable even at high print speed (e.g. 150 $m^2/h$). However, when printing at high speed, the response to high frequency is liable to be impaired and the ink tends to be unstable depending on the physical property of the ink, owing to the fact that the ink has to be discharged through minute nozzles at high velocity and at high frequency. Furthermore, the quality of the print tends to be impaired due to blotting on the both, partly because the ink jet printer does not allow the use of an ink having high viscosity and partly because both usually has rougher texture than paper, thus making it difficult to print patterns of minute or delicate design.

Accordingly there is a need for inkjet printing processes which can be conducted with high reliability, even when running at a high print speed, with an appreciable resolution and which have optimum characteristics from the standpoint of application technology. In this connection the properties of the inks used, such as the viscosity, stability, surface-tension and conductivity, play a decisive role. Furthermore, high demands are being made in terms of the quality of the resulting prints, e.g. in respect of colour strength, fibre-dye bond stability and fastness to wetting. Those demands are not met by the known processes in all characteristics, so that there is still a need for new processes for the ink-jet printing of textiles.

The invention relates to an inkjet printing process for printing textile fibre materials, wherein the fiber materials are printed with an aqueous ink comprising (I) at least one fiber reactive dye, and (II) a di, tri or tetramer of a $C_2$-$C_4$-oxyalkylene or a mono- or di-$C_1$-$C_4$-alkyl ether of a di, tri or tetramer of a $C_2$-$C_4$-oxyalkylene, said ink having a viscosity from 5 to 20 mPa s at 25° C., and wherein said ink is applied to the fiber material with an ink-jet print head comprising an ink supply layer (b) receiving ink from an external ink reservoir, said ink supply layer having a first side and a second side and comprising, a porous medium having a plurality of pores therein and a plurality of holes extending therethrough, so as to allow passage of the ink.

The dyes used in the inks should preferably have a low salt content, that is to say they should have a total content of salts of less than 0.5% by weight, based on the weight of the dyes. Dyes that have relatively high salt contents as a result of their preparation and/or as a result of the subsequent addition of diluents can be desalted, for example, by membrane separation procedures, such as ultrafiltration, reverse osmosis or dialysis.

The inks preferably have a total content of dyes of from 1 to 35% by weight, preferably from 1 to 30% by weight, especially from 1 to 20% by weight and more especially from 1 to 15% by weight based on the total weight of the ink. As a lower limit, a limit of 1.5% by weight, preferably 2% by weight and especially 3% by weight, is preferred.

As the fiber reactive dyes there come into consideration, for example, dyes of the formula $$A_1\text{-}(Z_1)_{1\text{-}3} \qquad (1),$$

wherein $A_1$ is the radical of a monoazo, disazo, polyazo, metal-complexed azo, anthraquinone, phthalocyanine, formazan or dioxazine chromophore having at least one sulfo group, and $(Z_1)_{1\text{-}3}$ is 1 to 3 identical or different fiber reactive radicals, or dyes of the formula (2)

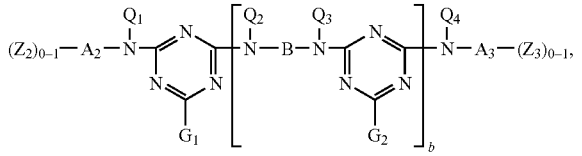

wherein $Q_1$, $Q_2$, $Q_3$ and $Q_4$ are each independently of the others hydrogen or unsubstituted or substituted $C_1$-$C_4$alkyl, $G_1$ und $G_2$ are halogen, B is an organic bridge member, $A_2$ and $A_3$ are each independently of the other as defined for $A_1$, or one of $A_2$ and $A_3$ is hydrogen or unsubstituted or substituted $C_1$-$C_4$alkyl, phenyl or naphthyl and the other one of $A_2$ and $A_3$ is as defined for $A_1$, $(Z_2)_{0\text{-}1}$ and $(Z_3)_{0\text{-}1}$ are each independently of the other 0 or 1 identical or different fiber reactive radicals, and b is the number 0 or 1.

The radicals $Q_1$, $Q_2$, $Q_3$ and $Q_4$ in the reactive dye of formula (1) as alkyl radicals are straight-chain or branched.

The alkyl radicals may be further substituted, for example by hydroxy, sulfo, sulfato, cyano or by carboxy. The following radicals may be mentioned by way of example: methyl, ethyl, propyl, isopropyl, butyl, isobutyl, sec-butyl and tert-butyl, and also the corresponding hydroxy-, sulfo-, sulfate, cyano- or carboxy-substituted radicals. Preferred as substituents are hydroxy, sulfo and sulfate, especially hydroxy and sulfato, and preferably hydroxy.

$Q_1$ and $Q_4$ are preferably hydrogen or $C_1$-$C_4$alkyl, especially hydrogen.

$Q_2$ and $Q_3$ are preferably each independently of the other hydrogen or unsubstituted or hydroxy-, sulfo-, sulfato-, cyano- or carboxy-substituted $C_1$-$C_4$alkyl. According to an embodiment of interest, one of the radicals $Q_2$ and $Q_3$ is hydroxy-, sulfo-, sulfate, cyano- or carboxy-substituted $C_1$-$C_4$alkyl, and the other of the radicals $Q_2$ and $Q_3$ is hydrogen or $C_1$-$C_4$alkyl, especially hydrogen.

$Q_2$ and $Q_3$ are especially preferably each independently of the other hydrogen or $C_1$-$C_4$alkyl, especially hydrogen.

$G_1$ und $G_2$ are preferably each independently of the other chlorine or fluorine, especially fluorine.

The following come into consideration as organic bridge members B, for example:

$C_2$-$C_{12}$alkylene radicals, especially $C_2$-$C_6$alkylene radicals, which may be interrupted by 1,2 or 3 members from the group —NH—, —N($CH_3$)— and —O—, especially —O—, and are unsubstituted or substituted by hydroxy, sulfo, sulfato, cyano or by carboxy, preferred substituents of the alkylene radicals mentioned for B being hydroxy, sulfo and sulfato, especially hydroxy;

$C_5$-$C_9$cycloalkylene radicals, such as especially cyclohexylene radicals, that are unsubstituted or substituted by $C_1$-$C_4$alkyl, $C_1$-$C_4$alkoxy, $C_2$-$C_4$alkanoylamino, sulfa, halogen or by carboxy, especially by $C_1$-$C_4$alkyl;

methylene-cyclohexylene-methylene radicals that are unsubstituted or substituted in the cyclohexylene ring by $C_1$-$C_4$alkyl;

$C_1$-$C_6$alkylenephenylene, or preferably phenylene, that is unsubstituted or substituted by $C_1$-$C_4$alkyl, $C_1$-$C_4$alkoxy, $C_2$-$C_4$alkanoylamino, sulfato halogen or by carboxy.

Also suitable as a radical of formula —N($Q_2$)—B—N($Q_3$)— is a radical of the formula

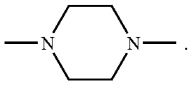

Preferably B is a $C_2$-$C_{12}$alkylene radical which may be interrupted by 1, 2 or 3 members from the group —NH—, —N($CH_3$)— and —O— and is unsubstituted or substituted by hydroxy, sulfo, sulfato, cyano or by carboxy; or a phenylene radical that is unsubstituted or substituted by $C_1$-$_4$alkyl, $C_1$-$C_4$alkoxy, $C_2$-$C_4$-alkanoylamino, sulfo, halogen or by carboxy.

B is especially a $C_2$-$C_{12}$alkylene radical which may be interrupted by 1, 2 or 3 members from the group —NH—, —N($CH_3$)— and —O—, especially —O—, and is unsubstituted or substituted by hydroxy, sulfo, sulfato, cyano or by carboxy. The alkylene radical is preferably unsubstituted or substituted by hydroxy, sulfo or by sulfato, especially by hydroxy.

B is more especially a $C_2$-$C_2$alkylene radical, especially a $C_2$-$C_6$alkylene radical, which may be interrupted by 1, 2 or 3 —O— members and is unsubstituted or substituted by hydroxy.

Bridge members B of special interest are $C_2$-$C_6$alkylene radicals.

Fibre-reactive radicals are to be understood as meaning those which are capable of reacting with the hydroxyl groups of cellulose, the amino, carboxyl, hydroxyl and thiol groups in wool and silk, or with the amino and possibly carboxyl groups of synthetic polyamides, to form covalent chemical bonds. The fibre-reactive radicals are as a rule bonded to the dye radical directly or via a bridge member. Suitable fibre-reactive radicals are, for example, those which contain at least one substituent which can be split off on an aliphatic, aromatic or heterocyclic radical, or in which the radicals mentioned contain a radical which is capable of reaction with the fibre material, for example a vinyl radical.

Preferably fiber reactive radicals $Z_1$, $Z_2$ and $Z_3$ independently of the other have the formula —$SO_2$—Y, (3a)

—NH—CO—$(CH_2)_l$—$SO_2$—Y, (3b)

—$CONR_2$—$(CH_2)_m$—$SO_2$—Y, (3c)

—NH—CO—CH(Hal)—$CH_2$—Hal, (3d)

—NH—CO—C(Hal)═$CH_2$, (3e)

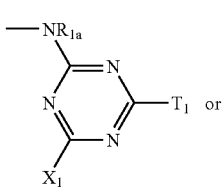

(3f)

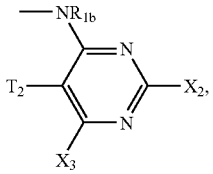

(3g)

in which

Hal is chlorine or bromine;

$X_1$ is halogen, 3-carboxypyridin-1-yl or 3-carbamoylpyridin-1-yl;

$T_1$ independently has the meaning of $X_1$, or is a substituent which is not fiber reactive or a fiber reactive radical of the formula

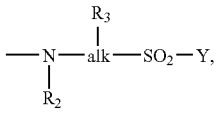

(4a)

—N(R1)—alk—Q—$alk_1$—$SO_2$—Y, (4b)

—N(R1)—arylene—$SO_2$—Y, (4c)

-continued

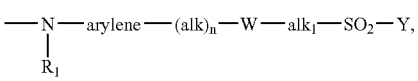

(4d)

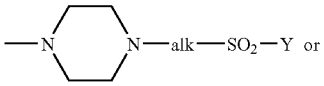

(4e)

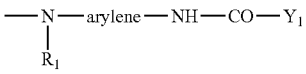

(4f)

in which $R_1$, $R_{1a}$ and $R_{1b}$ independently of one another are each hydrogen or $C_1$-$C_4$alkyl, $R_2$ is hydrogen, $C_1$-$C_1$alkyl which is unsubstituted or substituted by hydroxyl, sulfo, sulfato, carboxyl or cyano or a radical

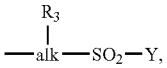

$R_3$ is hydrogen, hydroxyl, sulfo, sulfato, carboxyl, cyano, halogen, $C_1$-$C_4$alkoxycarbonyl, $C_1$-$C_4$alkanoyloxy, carbamoyl or the group —$SO_2$—Y, alk and $alk_1$ independently of one another are linear or branched $C_1$-$C_6$alkylene, arylene is a phenylene or naphthylene radical which is unsubstituted or substituted by sulfo, carboxyl, $C_1$-$C_4$alkyl, $C_1$-$C_4$alkoxy or halogen, Q is a radical —O— or —$NR_1$— in which $R_1$ is as defined above, W is a group —$SO_2$—$NR_2$—, —$CONR_2$— or —$NR_2CO$—, in which $R_2$ is as defined above, Y is vinyl or a radical —$CH_2CH_2$—U and U is a group which can be split off under alkaline conditions, $Y_1$ is a group —CH(Hal)$CH_2$-Hal or —C(Hal)=$CH_2$ and Hal is chlorine or bromine and l and m independently of one another are an integer from 1 to 6 and n is the number 0 or 1; and $X_2$ is halogen or $C_1$-$C_4$alkylsulfonyl;

$X_3$ is halogen or $C_1$-$C_4$alkyl and $T_2$ is hydrogen, cyano or halogen.

A group U which can be split off under alkaline conditions is, for example, —Cl, —Br, —F, —$OSO_3H$, —$SSO_3H$, —OCO—$CH_3$, —$OPO_3H_2$, —OCO—$C_6H_5$, —$OSO_2$—$C_1$-$C_4$alkyl or —$OSO_2$—N($C_1$-$C_1$-$C_4$alkyl)$_2$. U is preferably a group of the formula —Cl, —$OSO_3H$, —$SSO_3H$, —OCO—$CH_3$, —OCO—$C_6H_5$ or —$OPO_3H_2$, in particular —Cl or —$OSO_3H$, and particularly preferably —$OSO_3H$.

Examples of suitable radicals Y are accordingly vinyl, β-bromo- or β-chloroethyl, β-acetoxyethyl, β-benzoyloxyethyl, β-phosphatoethyl, β-sulfatoethyl and β-thiosulfatoethyl. Y is preferably vinyl, β-chloroethyl or β-sulfatoethyl, and in particular vinyl or β-sulfatoethyl.

$R_1$, $R_{1a}$, and $R_{1b}$ Independently of one another are each preferably hydrogen, methyl or ethyl, and particularly preferably hydrogen.

$R_2$ is preferably hydrogen or $C_1$-$C_4$alkyl, such as methyl, ethyl, propyl, isopropyl, butyl, isobutyl, sec-butyl or tertbutyl, and particularly preferably hydrogen, methyl or ethyl. $R_2$ is particularly preferably hydrogen.

$R_3$ is preferably hydrogen.

l and m independently of one another are preferably the number 2, 3 or 4, and particularly preferably the number 2 or 3.

Especially preferably, l is the number 3 and m is the number 2.

Substituents $T_1$ which are not fiber reactive are, for example, the following radicals:

hydroxyl;

$C_1$-$C_4$alkoxy, for example methoxy, ethoxy, n- or isopropoxy or n-, sec-, iso- or tert-butoxy, in particular methoxy or ethoxy; the radicals mentioned are unsubstituted or substituted in the alkyl moiety, for example by $C_1$-$C_4$alkoxy, hydroxyl, sulfo or carboxyl;

$C_1$-$C_4$alkylthio, for example methylthio, ethylthio, n- or isopropylthio or n-butylthio; the radicals mentioned are unsubstituted or substituted in the alkyl moiety, for example by $C_1$-$C_4$alkoxy, hydroxyl, sulfo or carboxyl;

amino;

N-mono- or N,N-di-$C_1$-$C_6$alkylamino, preferably N-mono- or N,N-di-$C_1$-$C_4$alkylamino; the radicals mentioned are unsubstituted, uninterrupted or interrupted in the alkyl moiety by oxygen or substituted in the alkyl moiety, for example by $C_2$-$C_4$alkanoylamino, $C_1$-$C_4$alkoxy, hydroxyl, sulfo, sulfato, carboxyl, cyano, carbamoyl or sulfamoyl; examples are N-methylamino, N-ethylamino, N-propylamino, N,N-di-methylamino or N,N-di-ethylamino, N-β-hydroxyethylamino, N,N-dihydroxyethylamino, N-2-(hydroxyethoxy)ethylamino, N-2-(β-hydroxyethoxy)ethylamino, N-2-[2-(β-hydroxyethoxy)]ethylamino, N-β-sulfatoethylamino, N-β-sulfoethylamino, N-carboxymethylamino, N-β-carboxyethylamino, N-α,β-dicarboxyethylamino, N-α,γ-dicarboxypropylamino, N-ethyl-N-β-hydroxyethylamino or N-methyl-N-β-hydroxyethylamino;

$C_5$-$C_7$cycloalkylamino, for example cyclohexylamino, which includes both the unsubstituted radicals and the radicals substituted in the cycloalkyl ring, for example by $C_1$-$C_4$alkyl, in particular methyl, or carboxyl;

phenylamino or N—$C_1$-$C_4$alkyl-N-phenylamino, which includes both the unsubstituted radicals and the radicals substituted in the phenyl ring, for example by $C_1$-$C_4$alkyl, $C_1$-$C_4$alkoxy, $C_2$-$C_4$alkanoylamino, carboxyl, carbamoyl, sulfo or halogen, for example 2-, 3- or 4-chlorophenylamino, 2-, 3- or 4-methylphenylamino, 2-, 3- or 4-methoxyphanylamino, 2-, 3- or 4-sulfophenylamino, disulfophenylamino or 2-, 3- or 4-carboxyphenylamino; naphthylamino which is unsubstituted or substituted in the naphthyl ring, for example by sulfo, preferably the radicals substituted by 1 to 3 sulfo groups, for example 1- or 2-naphthylamino, 1-sulfo-2-naphthylamino, 1,5-disulfo-2-naphthylamino or 4,8-disulfo-2-naphthylamino; or benzylamino which is unsubstituted or substituted in the phenyl moiety, for example by $C_1$-$C_4$alkyl, $C_1$-$C_4$alkoxy, carboxyl, sulfo or halogen.

A radical $T_1$ which is not fiber reactive is preferably $C_1$-$C_4$alkoxy, $C_1$-$C_4$alkylthio, hydroxyl, amino, N-mono- or N,N-di-$C_1$-$C_4$alkylamino which are optionally substituted in the alkyl moiety by hydroxyl, sulfato or sulfo, morpholino, phenylamino or N—$C_1$-$C_4$alkyl-N-phenylamino which are unsubstituted or substituted in the phenyl ring by sulfo, carboxyl, acetylamino, chlorine, methyl or methoxy and in which the alkyl is unsubstituted or substituted by hydroxyl, sulfo or sulfato, or naphthylamino which is unsubstituted or substituted by 1 to 3 sulfo groups.

Particularly preferred radicals $T_1$ which are not fiber reactive are amino, N-methylamino, N-ethylamino, N-β-hydroxyethylamino, N-methyl-N-β-hydroxyethylamino, N-β-ethyl-N-β-hydroxyethylamino, N,N-di-β-hydroxyethylamino, N-β-sulfatoethylamino, N-β-sulfoethylamino, morpholino, 2-, 3- or 4-carboxyphenylamino, 2-, 3- or 4-sulfophenylamino or N—$C_1$-$C_4$-alkyl-N-phenylamino.

$X_1$ is preferably halogen, for example fluorine, chlorine or bromine, and particularly preferably chlorine or fluorine.

Halogen $T_2$, $X_2$ and $X_3$ are, for example, fluorine, chlorine or bromine, in particular chlorine or fluorine.

$C_1$-$C_4$alkylsulfonyl $X_2$ is, for example, ethylsulfonyl or methylsulfonyl, and in particular methylsulfonyl.

$C_1$-$C_4$alkyl $X_3$ is, for example, methyl, ethyl, n- or iso-propyl or n-, iso or tert-butyl, and in particular methyl.

$X_2$ and $X_3$ independently of one another are preferably chlorine or fluorine.

$T_2$ is preferably cyano or chlorine.

Hal is preferably bromine.

alk and $alk_1$ independently of one another are, for example, a methylene, ethylene, 1,3-propylene, 1,4-butylene, 1,5-pentylene or 1,6hexylene radical or branched isomers thereof.

alk and $alk_1$ independently of one another are preferably each a $C_1$-$C_4$alkylene radical, and particularly preferably an ethylene radical or propylene radical.

arylene is preferably a 1,3- or 1,4-phenylene radical which is unsubstituted or substituted, for example by sulfo, methyl, methoxy or carboxyl, and particularly preferably an unsubstituted 1,3- or 1,4-phenylene radical.

Q is preferably —NH— or —O—, and particularly preferably —O—.

W is preferably a group of the formula —CONH— or —NHCO—, in particular a group of the formula —CONH—.

n is preferably the number 0.

The reactive radicals of the formulae (4a) to (4f) are preferably those in which W is a group of the formula —CONH—. $R_1$, $R_2$ and $R_3$ are each hydrogen, Q is the radical —O— or —NH—, alk and $Alk_1$ independently of one another are each ethylene or propylene, arylene is phenylene which is unsubstituted or substituted by methyl, methoxy, carboxyl or sulfo, Y is vinyl or β-sulfatoethyl, $Y_1$ is —CHBr—$CH_2$Br or —CBr=$CH_2$ and n is the number 0.

A fibre-reactive radical $Z_1$, $Z_2$ and $Z_3$ is particularly preferably a radical of the formula (3a), (3c), (3d), (3e) or (3f), in which Y is vinyl, β-chloroethyl or β-sulfatoethyl, Hal is bromine, $R_2$ and $R_{1a}$ are hydrogen, m is the number 2 or 3, $X_1$ is halogen, $T_1$ is $C_1$-$C_4$alkoxy, $C_1$-$C_4$alkylthio, hydroxyl, amino, N-mono- or N,N-di-$C_1$-$C_4$alkylamino which are unsubstituted or substituted in the alkyl moiety by hydroxyl, sulfato or sulfo, morpholino, phenylamino or N—$C_1$-$C_4$alkyl-N-phenylamino which are unsubstituted or substituted in the phenyl ring by sulfo, carboxyl, acetylamino, chlorine, methyl or methoxy and in which the alkyl is unsubstituted or substituted by hydroxyl, sulfo or sulfato, or naphthylamino which is unsubstituted or substituted by 1 to 3 sulfo groups, or a fibre-reactive radical of the formula $$—NH—(CH_2)_{2-3}—SO_2Y, \quad (4a')$$

$$—NH—(CH_2)_{2-3}—O—(CH_2)_{2-3}—SO_2Y, \quad (4b')$$

(4c')

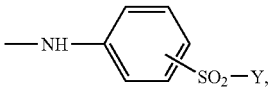

-continued (4d')

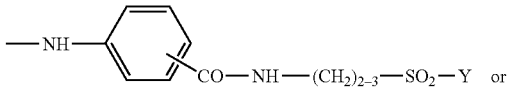

or (4f')

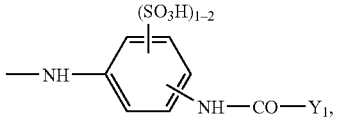

in particular (4b'), (4c') or (4d'), in which

Y is as defined above and $Y_1$ is a group —CH(Br)—$CH_2$Br or —C(Br)=$CH_2$.

Preferred are dyes of the formula (1) which contain 1 or 2, in particular 2, fiber reactive radicals $Z_1$.

Preferred are dyes of the formula (2) which do not contain fiber reactive radicals $Z_2$ and $Z_3$.

When one of $A_2$ and $A_3$ is unsubstituted or substituted $C_1$-$C_4$alkyl, phenyl or naphthyl, it may be, for example, $C_1$-$C_4$alkyl that is unsubstituted or substituted by sulfo, sulfato, hydroxy, carboxy or by phenyl; or phenyl or naphthyl each of which is unsubstituted or substituted by $C_1$-$C_4$alkyl, $C_1$-$C_4$alkoxy, carboxy, sulfo or by halogen. Preference is given to phenyl that is unsubstituted or substituted by $C_1$-$C_4$alkyl, $C_1$-$C_4$alkoxy, carboxy, sulfo or by halogen.

Preferably $A_2$ and $A_3$ are each independently of the other the radical of a monoazo, polyazo, metal-complexed azo, anthraquinone, phthalocyanine, formazan or dioxazine chromophore having at least one sulfo group.

A radical $A_1$, $A_2$ or $A_3$ as the radical of a monoazo, polyazo, metal-complexed azo, anthra-quinone, phthalocyanine, formazan or dioxazine chromophore may have the substituents customary in organic dyes bonded to its base structure.

The following may be mentioned as examples of substituents in the radicals $A_1$, $A_2$ and $A_3$: alkyl groups having from 1 to 4 carbon atoms, such as methyl, ethyl, propyl, isopropyl or butyl, it being possible for the alkyl radicals to be further substituted e.g. by hydroxy, sulfo or by sulfato; alkoxy groups having from 1 to 4 carbon atoms, such as methoxy, ethoxy, propoxy, isopropoxy or butoxy, it being possible for the alkyl radicals to be further substituted e.g. by hydroxy, sulfo or by sulfato; phenyl that is unsubstituted or substituted by $C_1$-$C_4$alkyl, $C_1$-$C_4$alkoxy, halogen, carboxy or by sulfo; acylamino groups having from 1 to 8 carbon atoms, especially such alkanoylamino groups, e.g. acetylamino or propionylamino; benzoyl-amino that is unsubstituted or substituted in the phenyl ring by $C_1$-$C_4$alkyl, $C_1$-$C_4$alkoxy, halogen or by sulfo; phenylamino that is unsubstituted or substituted in the phenyl ring by $C_1$-$C_4$alkyl, $C_1$-$C_4$alkoxy, halogen or by sulfo; N,N-di-β-hydroxyethylamino; N,N-di-β-sulfato-ethylamino; sulfobenzylamino; N,N-disulfobenzylamino; alkoxycarbonyl having from 1 to 4 carbon atoms in the alkoxy radical, such as methoxycarbonyl or ethoxycarbonyl; alkylsulfonyl having from 1 to 4 carbon atoms, such as methylsulfonyl or ethylsulfonyl; trifluoromethyl; nitro; amino; cyano; halogen, such as fluorine, chlorine or bromine; carbamoyl; N-alkyl-carbamoyl having from 1 to 4 carbon atoms in the alkyl radical, such as N-methylcarbamoyl or N-ethylcarbamoyl; sulfamoyl; N-mono- or N,N-di-alkylsulfamoyl each having from 1 to 4 carbon atoms, such as N-methylsulfonamoyl, N-thylsulfamoyl, N-propylsulfamoyl, N-isopropylsulfamoyl or N-butylsulfamoyl, it being possible for the alkyl radicals to be further substituted e.g. by hydroxy or by sulfo; N-(β-hydroxyethylisulfamoyl; N,N-di(β-hydroxyethyl)-sulfamoyl; N-phenylsulfamoyl that is unsubstituted or substituted by $C_1$-$C_4$alkyl, $C_1$-$C_4$alkoxy, halogen, carboxy or by sulfo; ureido; hydroxy; carboxy; sulfomethyl or sulfo.

When $A_1$, $A_2$ and $A_3$ are the radical of a monoazo, polyazo or metal-complexed azo chromophore, the following radicals, especially, come into consideration:

Chromophore radicals of a mono- or dis-azo dye of formula $$\text{D-N=N-(M-N=N)}_u\text{—K—} \quad (5),$$

$$\text{-D-N=N-(M-N=N)}_u\text{—K} \quad (6)$$

or $$\text{-D-N=N—K—N=N-D*-} \quad (7),$$

wherein D und D* independently of the other are the radicals of a diazo component of the benzene or naphthalene series, M is the radical of a middle component of the benzene or naphthalene series, K is the radical of a coupling component of the benzene, naphthalene, pyrazolone, 6-hydroxypyridone-(2) or acetoacetic acid arylamide series and u is the number 0 or 1, it being possible in the case of azo dyes for D, D*, M and K to carry customary substituents, e.g. $C_1$-$C_4$alkyl or $C_1$-$C_4$alkoxy each of which is unsubstituted or may be further substituted by hydroxy, sulfo or by sulfato; halogen; carboxy; sulfo; nitro; cyano; trifluoromethyl; sulfamoyl; carbamoyl; amino; ureido; hydroxy; carboxy; sulfomethyl; $C_2$-$C_4$alkanoylamino; benzoylamino that is unsubstituted or substituted in the phenyl ring by $C_1$-$C_4$alkyl, $C_1$-$C_4$alkoxy, halogen or by sulfo; phenyl that is unsubstituted or substituted by $C_1$-$C_4$alkyl, $C_1$-$C_4$alkoxy, halogen, carboxy or by sulfo. Also suitable are the metal complexes derived from the above dye radicals of formulae (5), (6) and (7), especially dye radicals of a 1:1 copper-complexed azo dye of the benzene or naphthalene series wherein the copper atom is bonded to a group capable of metallation, e.g. a hydroxy group, on each side in the ortho-position to the azo bridge.

The radicals of formulae (5), (6) and (7) are preferably those of formula (8a)

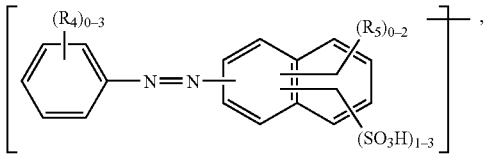

wherein $(R_4)_{0-3}$ denotes from 0 to 3 identical or different substituents from the group $C_1$-$C_4$alkyl, $C_1$-$C_4$alkoxy, $C_2$-$C_4$alkanoylamino, ureido, sulfamoyl, carbamoyl, sulfomethyl, halogen, nitro, cyano, trifluoromethyl, amino, hydroxy, carboxy and sulfo, $(R_5)_{0-2}$ denotes from 0 to 2 identical or different substituents from the group hydroxy, amino, N-mono-$C_1$-$C_4$alkylamino, N,N-di-$C_1$-$C_4$alkylamino, $C_2$-$C_4$alkanoylamino and benzoylamino;

(8b)

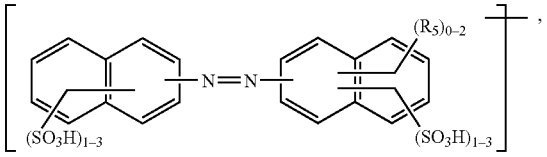

wherein $(R_5)_{0-2}$ is as defined above;

(8c)

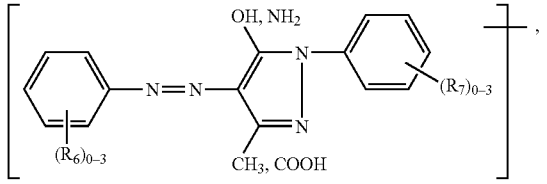

wherein $(R_6)_{0-3}$ und $(R_7)_{0-3}$ independently of the other denotes from 0 to 3 identical or different substituents from the group $C_1$-$C_4$alkyl, $C_1$-$C_4$alkoxy, halogen, carboxy and sulfo;

(8d)

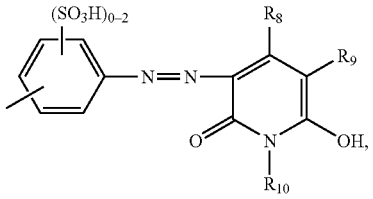

wherein $R_8$ und $R_{10}$ are each independently of the other hydrogen, $C_1$-$C_4$alkyl or phenyl, and $R_9$ hydrogen, cyano, carbamoyl or sulfomethyl;

(8e)

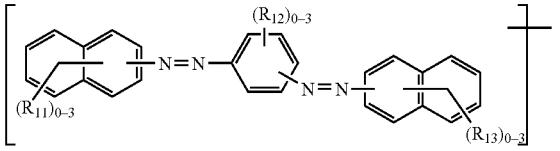

wherein $(R_{12})_{0-3}$ denotes from 0 to 3 identical or different substituents from the group $C_1$-$C_4$alkyl, $C_1$-$C_4$alkoxy, halogen, amino, carboxy and sulfo, and $(R_{11})_{0-3}$ and $(R_{13})_{0-3}$ independently of the other are as defined for $(R_4)_{0-3}$;

(8f)

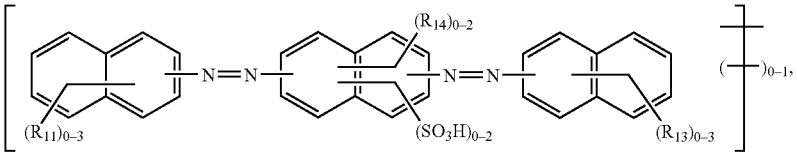

wherein $(R_{11})_{0-3}$ and $(R_{13})_{0-3}$ independently of the other are as defined above $(R_{14})_{0-2}$ denotes from 0 to 2 identical or different substituents from the group $C_1$-$C_4$alkyl.

$C_1$-$C_4$alkoxy, halogen, carboxy, sulfo, hydroxy, amino, N-mono-$C_1$-$C_4$alkylamino, N,N-di-$C_1$-$C_4$alkylamino, $C_2$-$C_4$alkanoylamino and benzoylamino.

When $A_1$, $A_2$ and $A_3$ are the radical of a formazan dye the following radicals, especially, come into consideration:

(9)

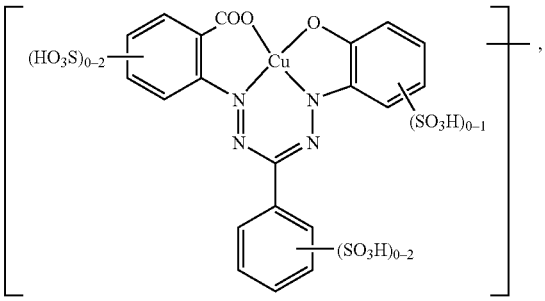

wherein the benzene nuclei do not contain any further substituents or are further substituted by $C_1$-$C_4$alkyl, $C_1$-$C_4$alkoxy, $C_1$-$C_4$alkylsulfonyl, halogen or by carboxy.

When $A_1$, $A_2$ and $A_3$ are the radical of a phthalocyanine dye the following radicals, especially, come into consideration:

(10)

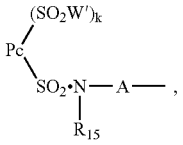

wherein

Pc is the radical of a metal phthalocyanine, especially the radical of a copper or nickel phthalocyanine, W' is —OH and/or —$NR_{18}R_{16}$' and $R_{16}$ and $R_{16}$' are each independently of the other hydrogen or $C_1$-$C_4$alkyl that is unsubstituted or substituted by hydroxy or by sulfo, $R_{15}$ is hydrogen or $C_1$-$C_4$alkyl, A is a phenylene radical that is unsubstituted or substituted by $C_1$-$C_4$alkyl, $C_1$-$C_4$alkoxy, halogen, carboxy or by sulfo or is a $C_2$-$C_6$alkylene radical and k is from 1 to 3.

When $A_1$, $A_2$ and $A_3$ are the radical of a dioxazine dye the following radicals, especially, come into consideration:

(11)

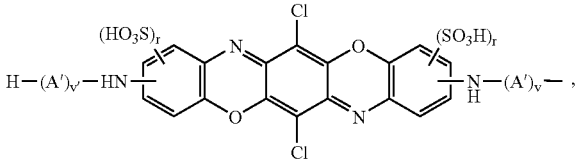

wherein

A' is a phenylene radical that is unsubstituted or substituted by $C_1$-$C_4$alkyl, $C_1$-$C_4$alkoxy, halogen, carboxy or by sulfo or is a $C_2$-$C_6$alkylene radical, r independently is the number 0, 1 or 2, preferably 0 or 1, and v and v' are each independently of the other the number 0 or 1.

When $A_1$, $A_2$ and $A_3$ are the radical of a anthrachinon dye the following radicals, especially, come into consideration:

(12)

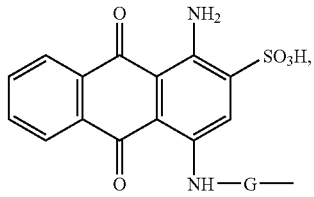

wherein

G is a phenylene radical that is unsubstituted or substituted by $C_1$-$C_4$alkyl, $C_1$-$C_4$alkoxy, halogen, carboxy or by sulfo or is a cyclohexylene, phenylenemethylene or $C_2$-$C_6$alkylene radical.

Preferably b in the dye of formula (2) is the number 1.

Special interest is accorded to reactive dyes of formulae (1.1)
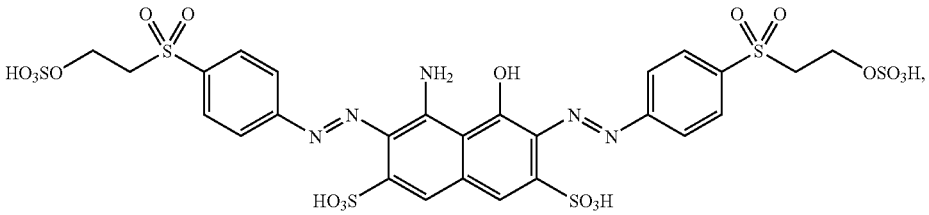
(1.2)
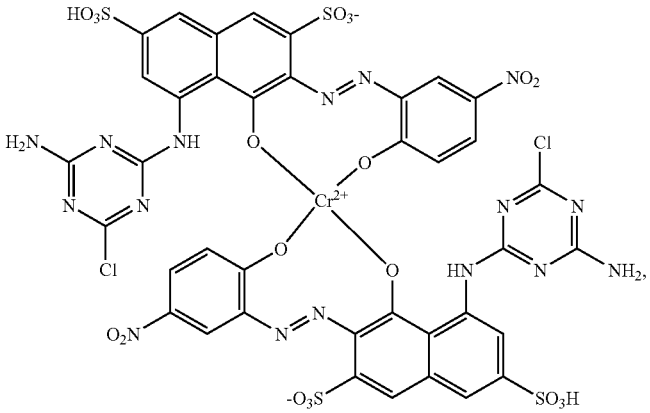
(1.3)
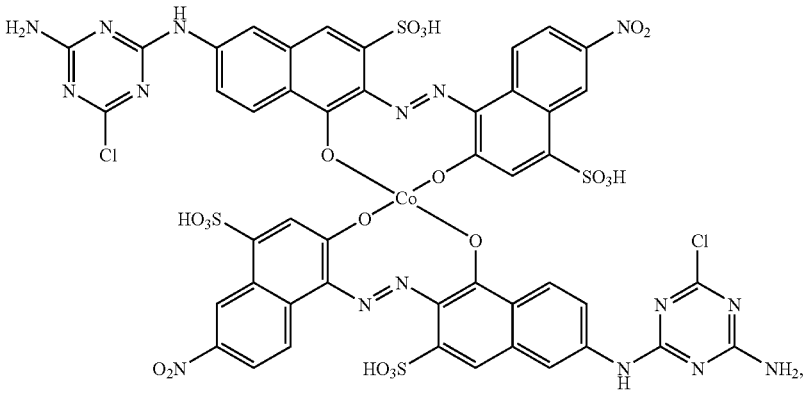
(1.4)
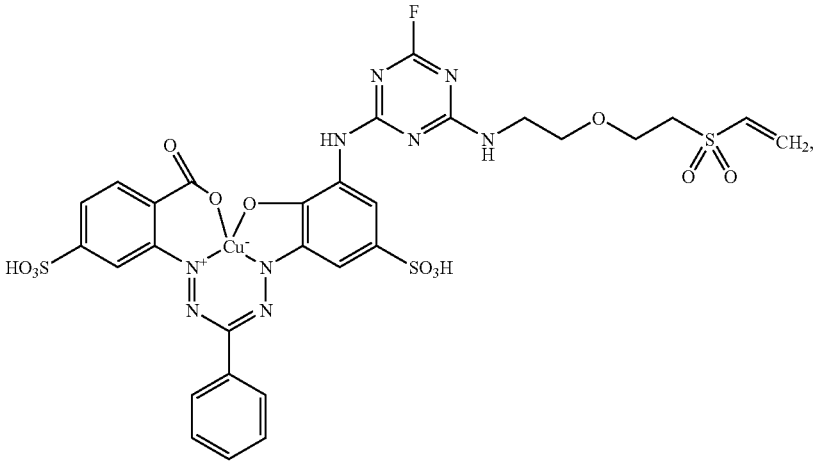

-continued
(1.5)
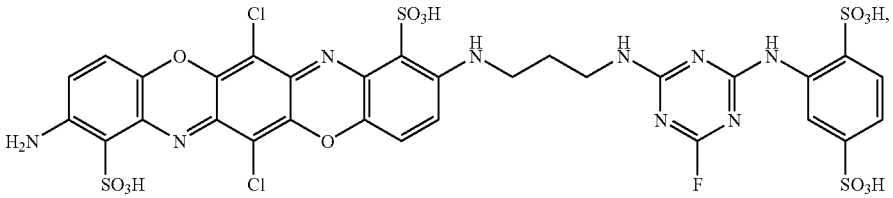
(1.6)
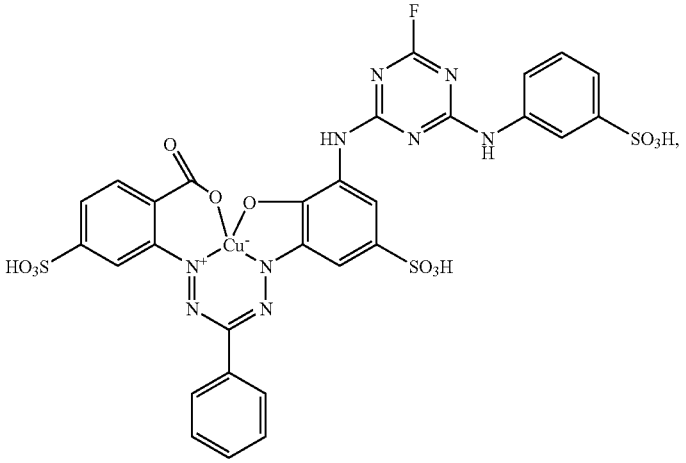
(1.7)
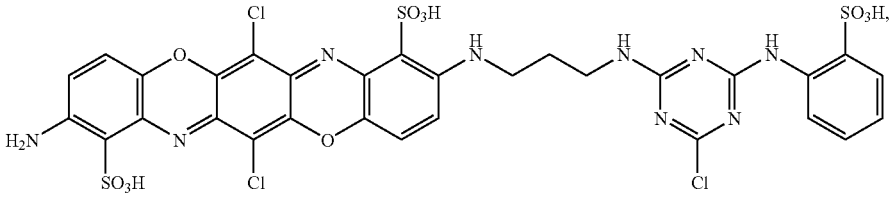
(1.8)
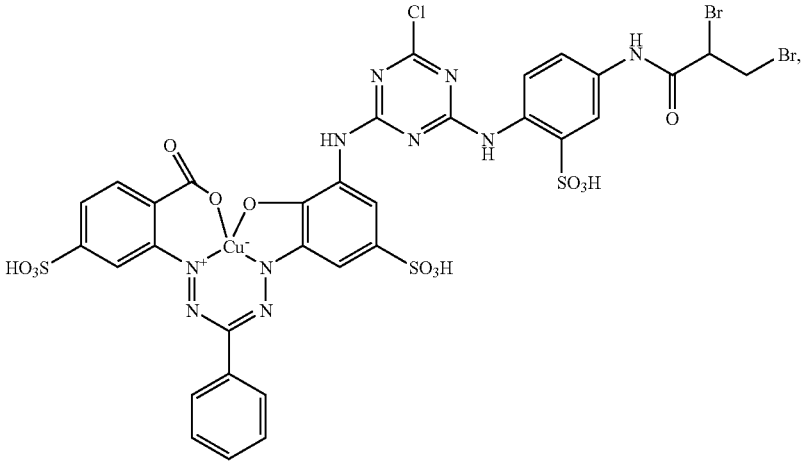
(1.9)
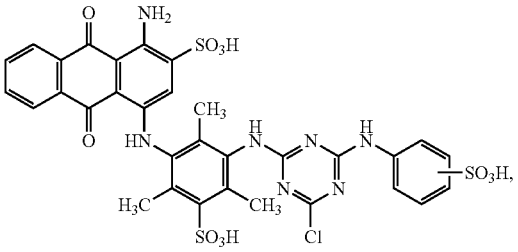
(1.10)
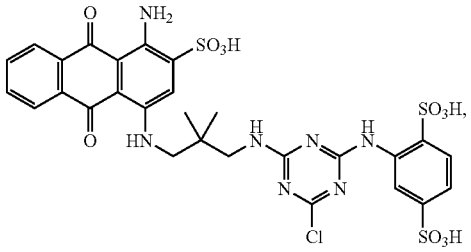

-continued
(1.11)
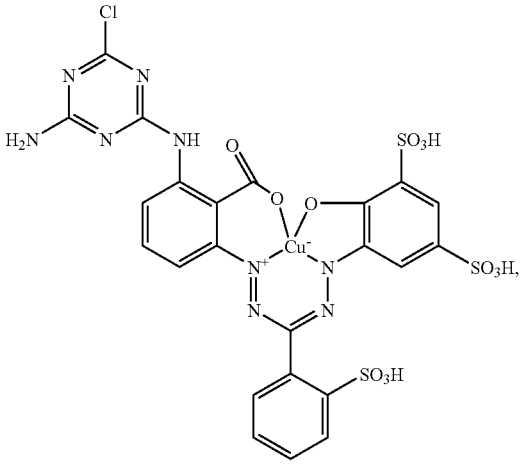
(1.12)
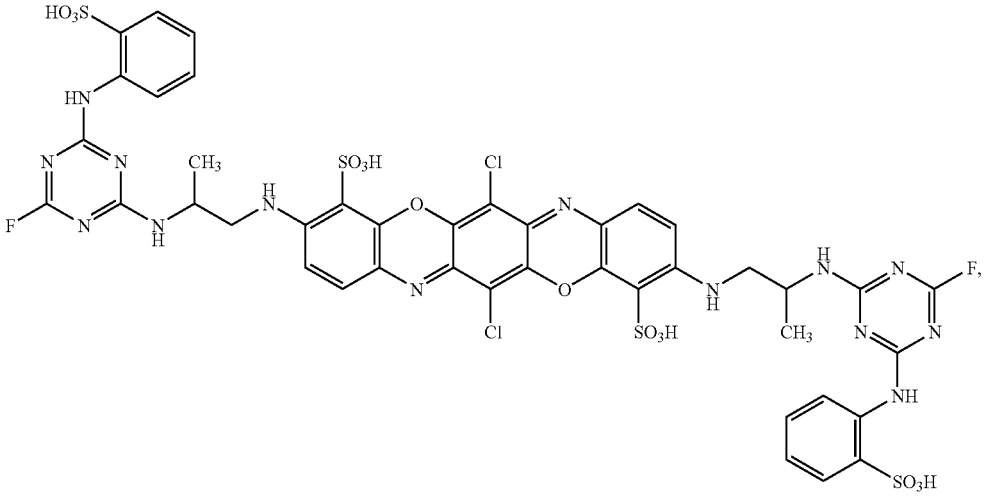
(1.13)
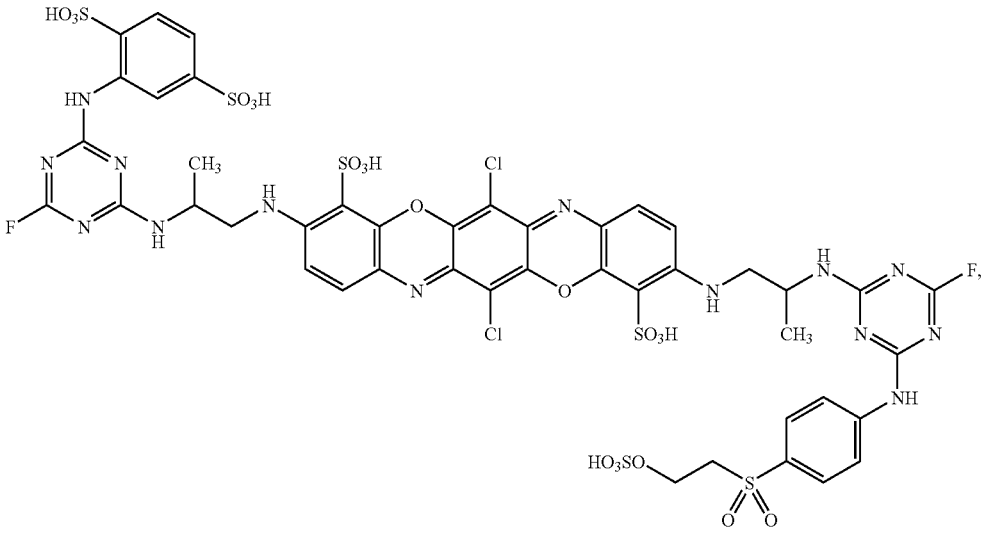

-continued
(1.14)
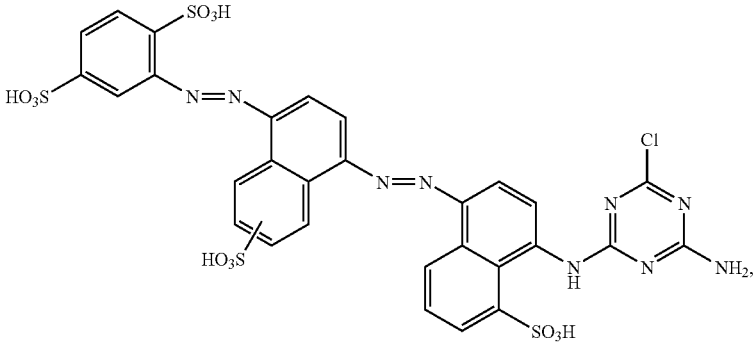
(1.15)
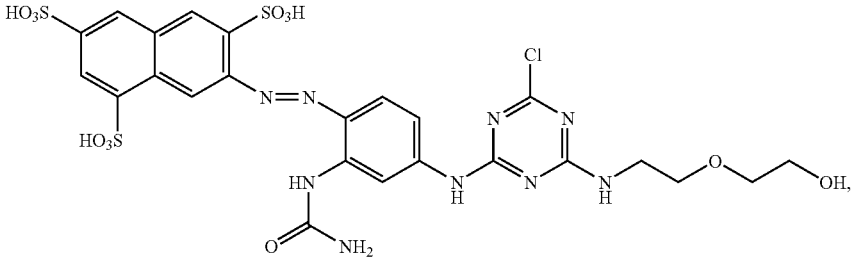
(1.16)
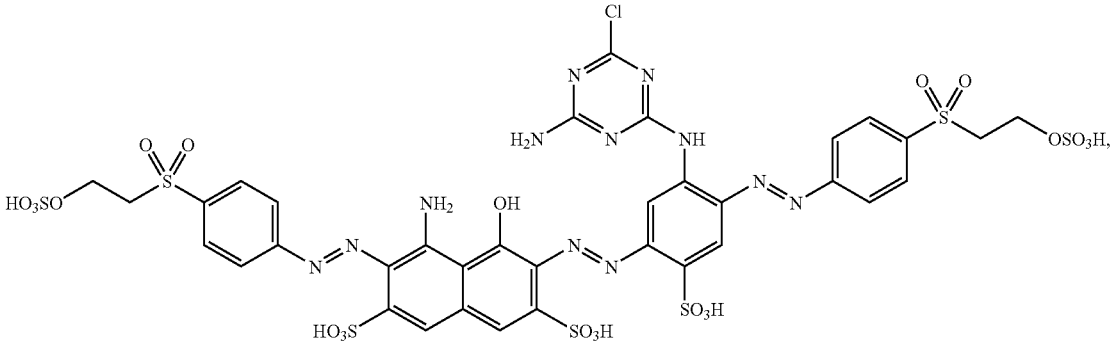
(1.17)
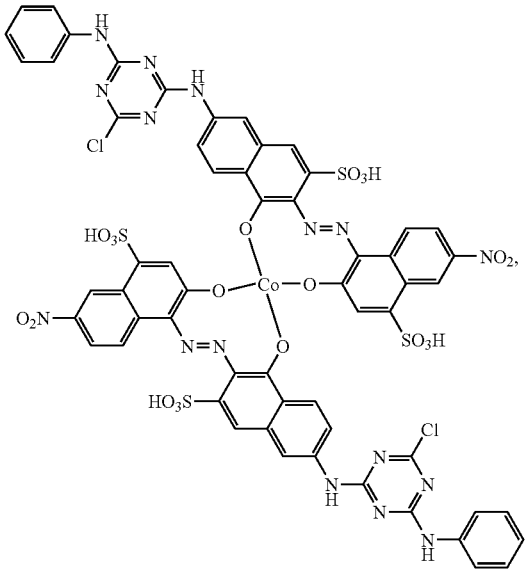
(1.18)
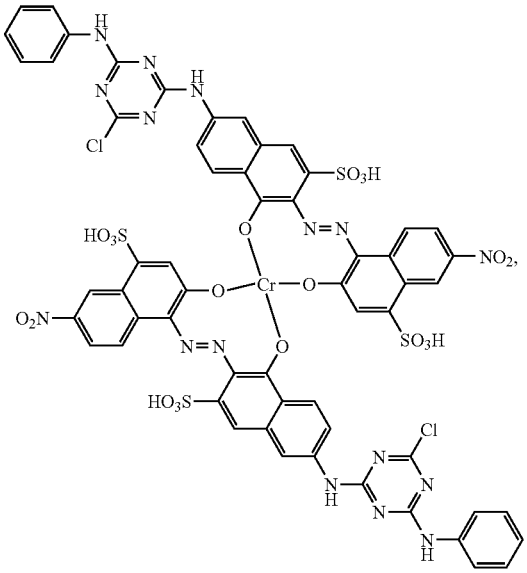

-continued
(1.19)
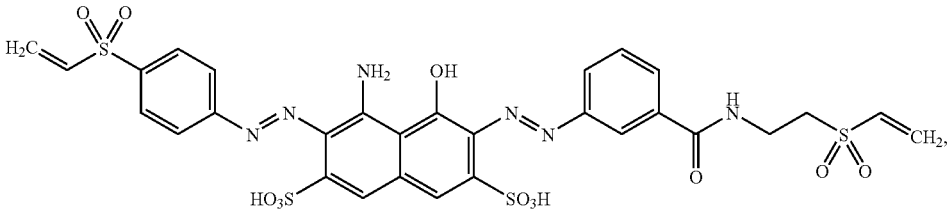
(1.20)
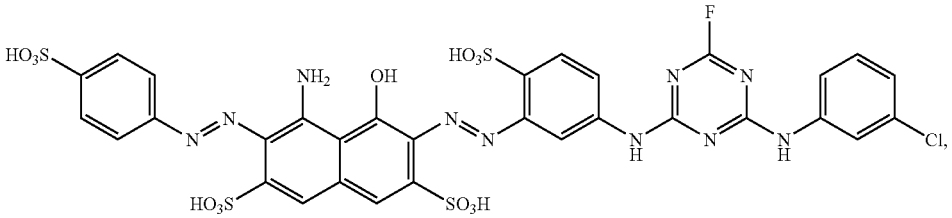
(1.21)
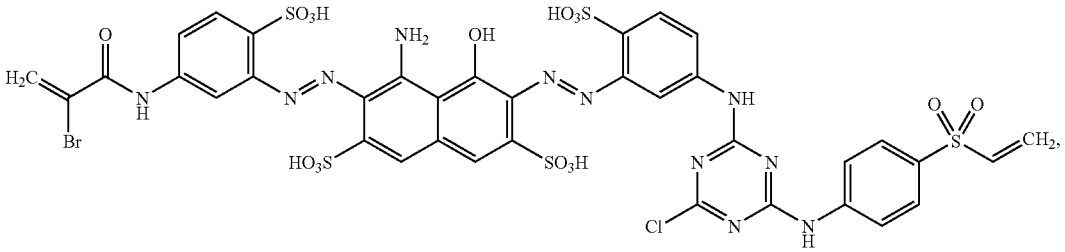
(1.22)
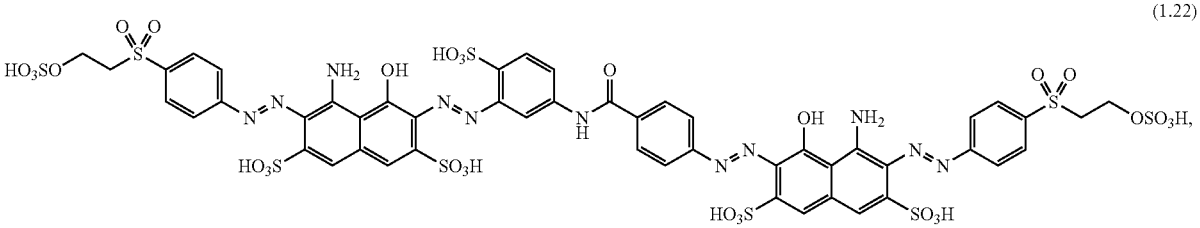
(1.23)
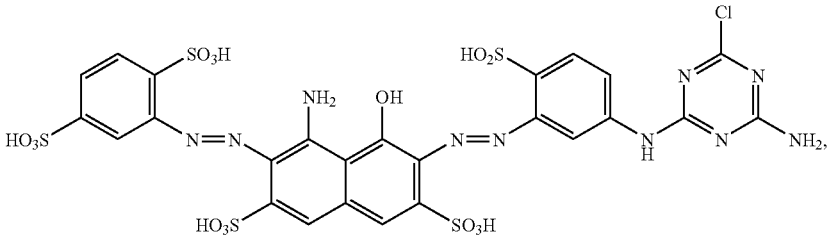
(1.24)
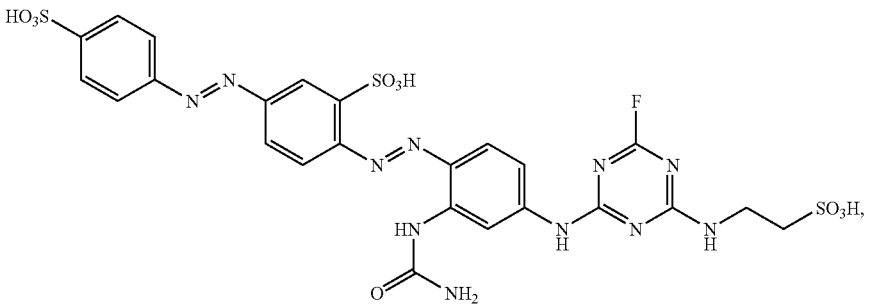

-continued
(1.25)
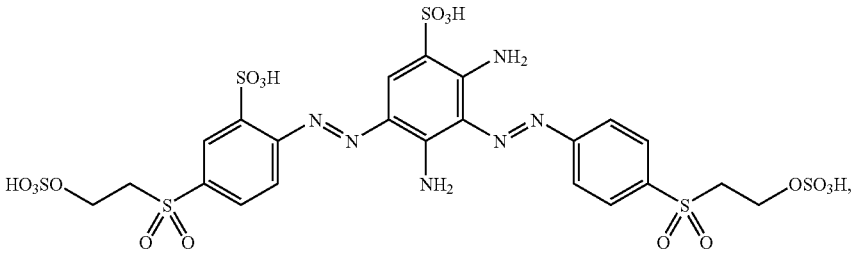
(1.26)
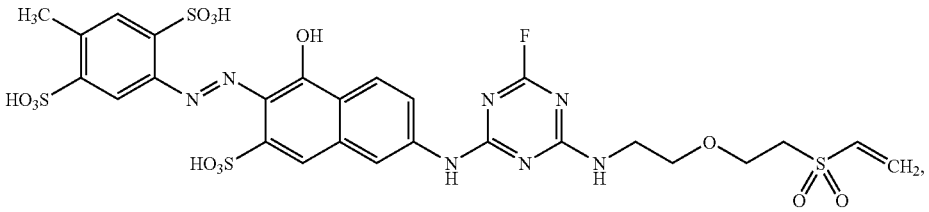
(1.27)
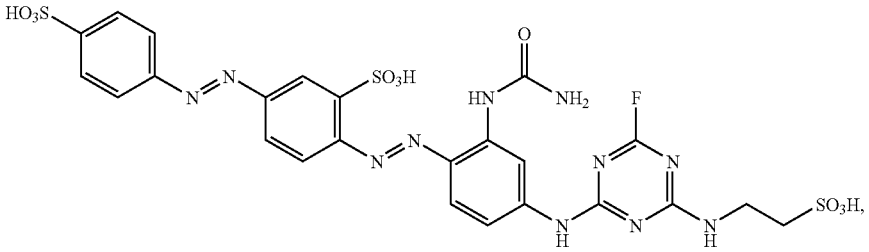
(1.28)
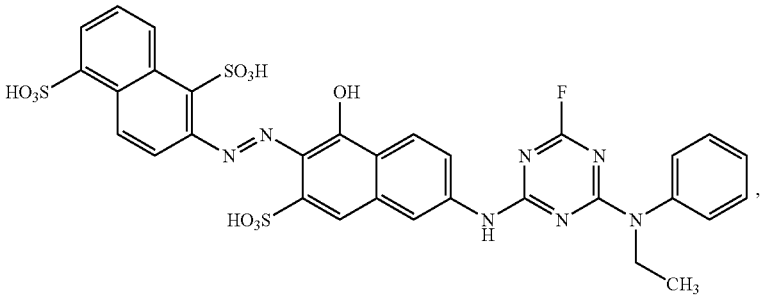
(1.29)
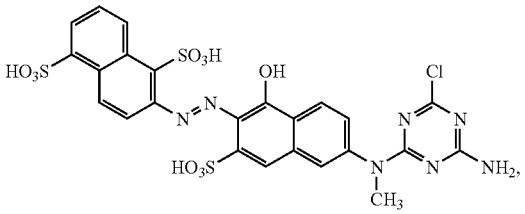
(1.30)
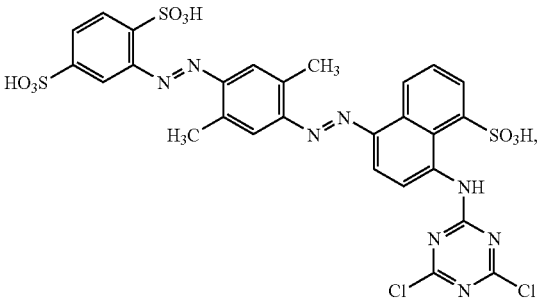

-continued
(1.31)
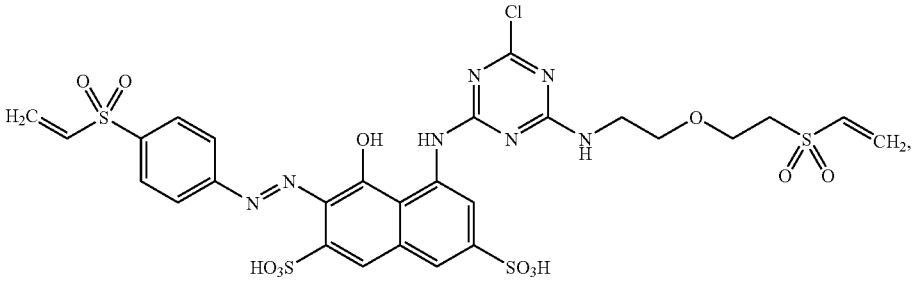
(1.32)
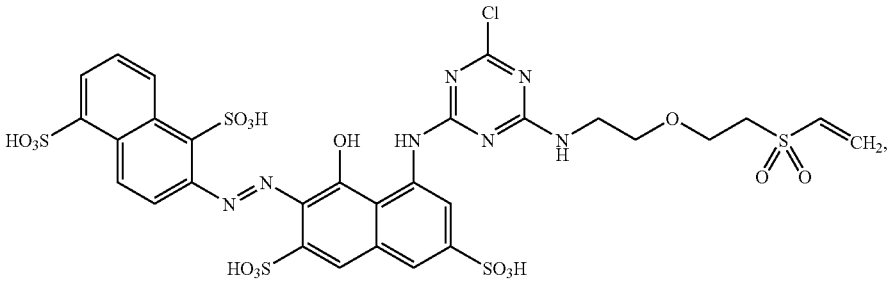
(1.33)
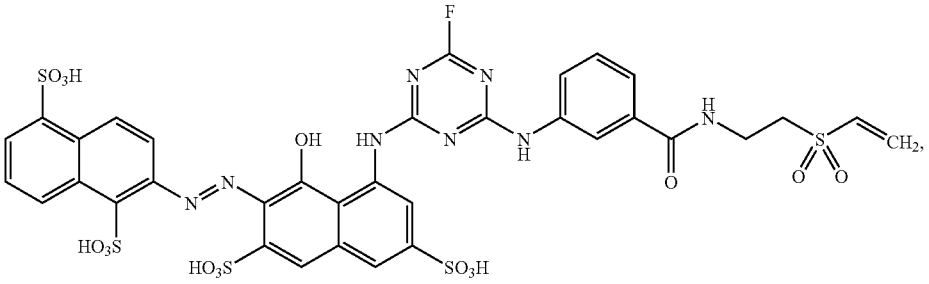
(1.34)
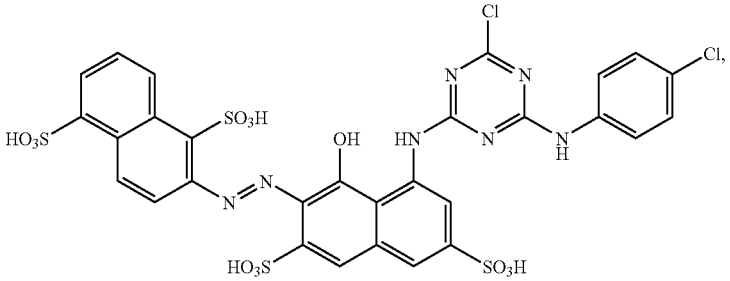
(1.35)
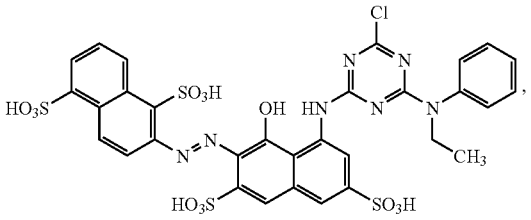
(1.36)
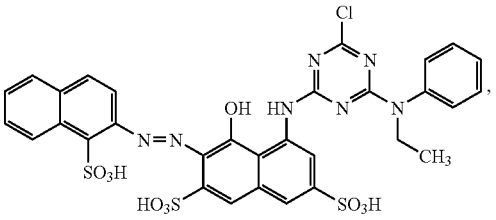

-continued
(1.37)
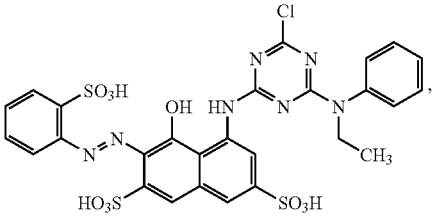
(1.38)
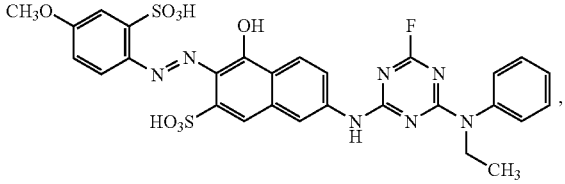
(1.39)
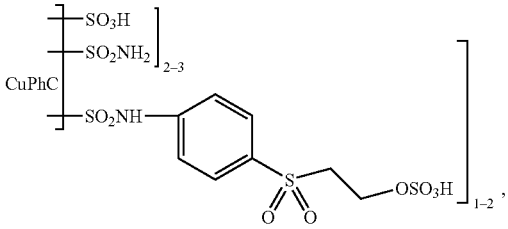
CuPhC = Cu-Phthalocycanin
(1.40)
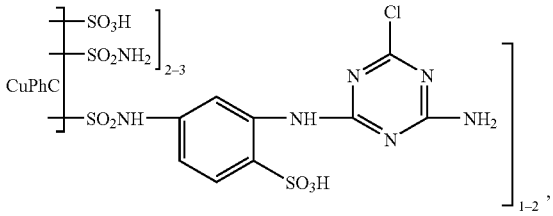
CuPhC = Cu-Phthalocyanin
(1-41)
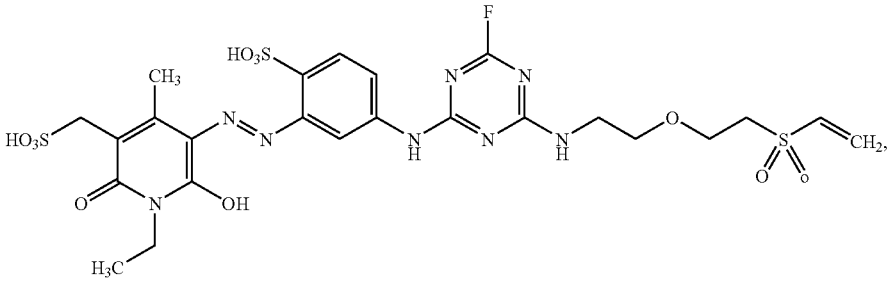
(1.42)
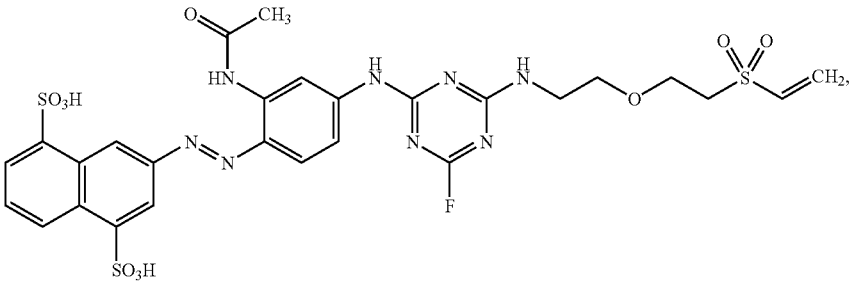
(1.43)
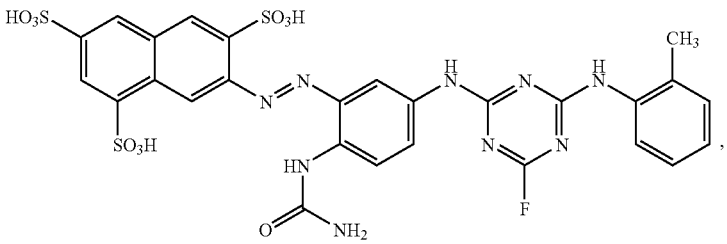

-continued
(1.44)
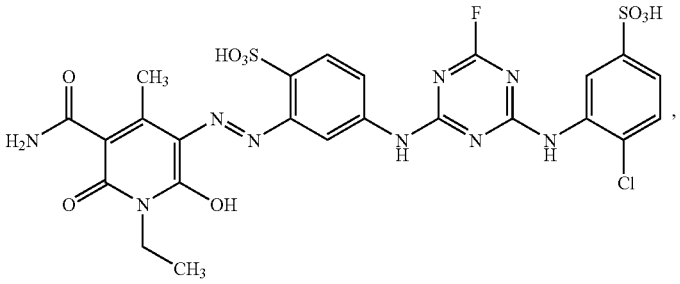
(1.45)
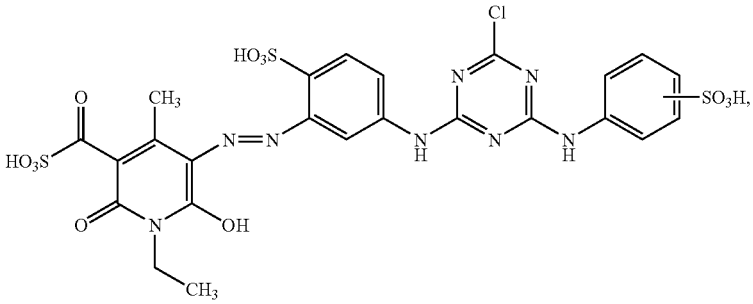
(1.46)
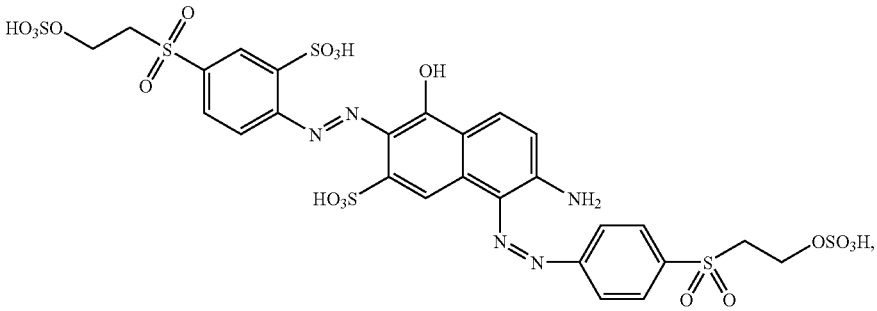
(1.47)
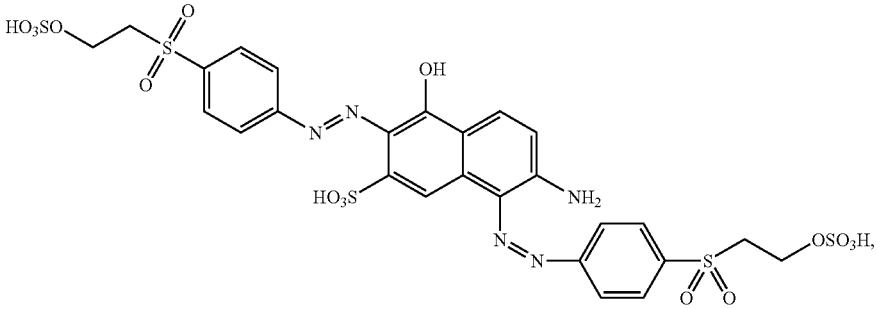
(1.48)
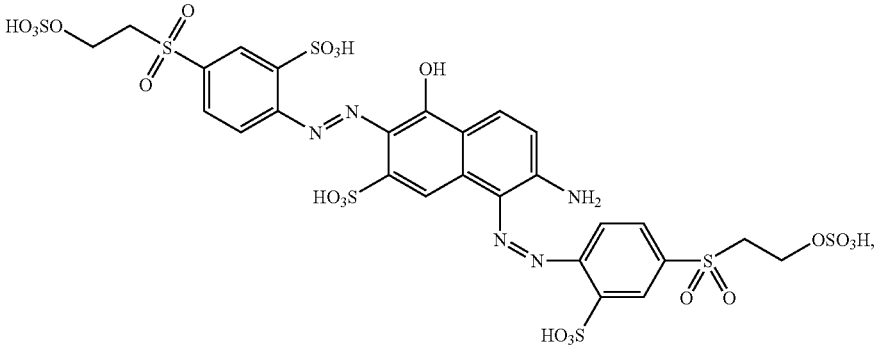

-continued
(1.49)
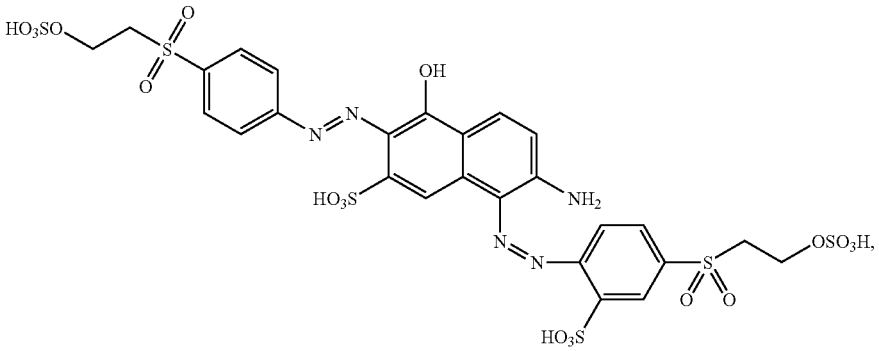
(1.50)
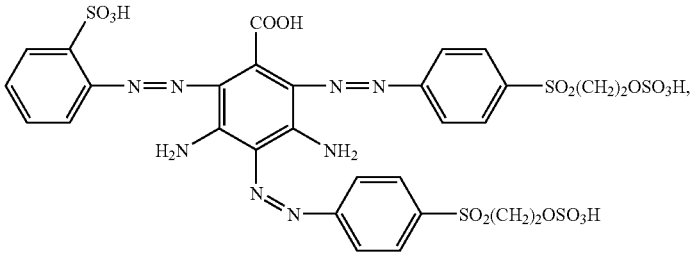
(2.1)
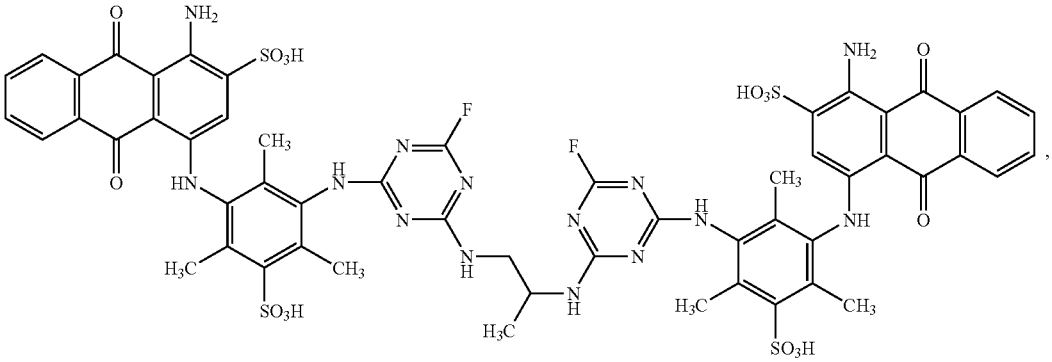
(2.2)
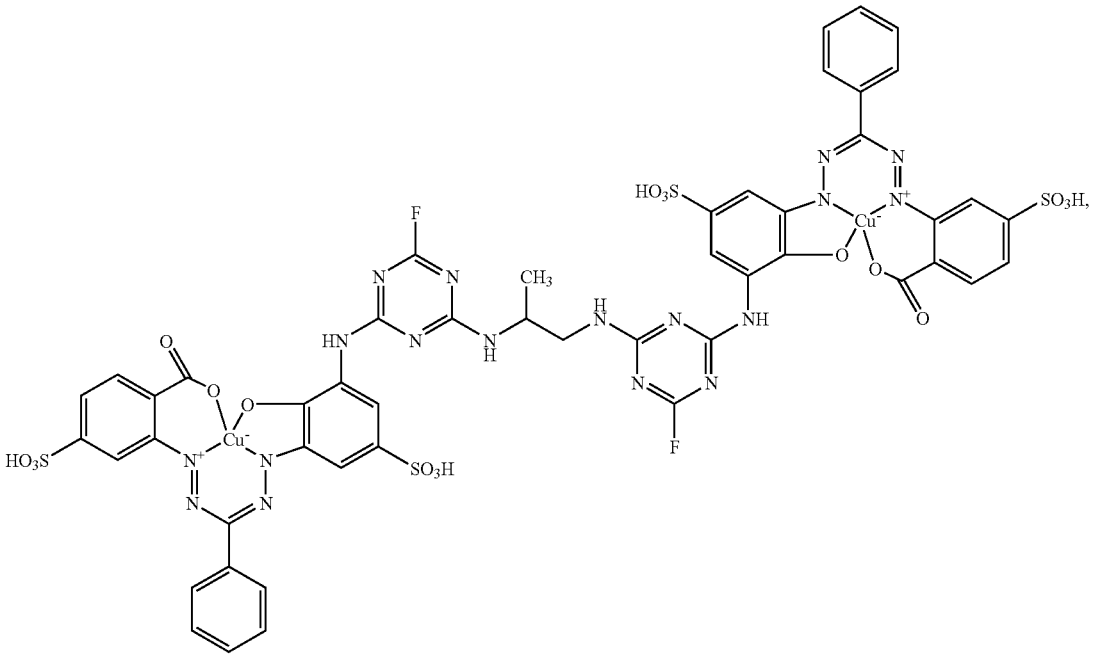

-continued
(2.3)
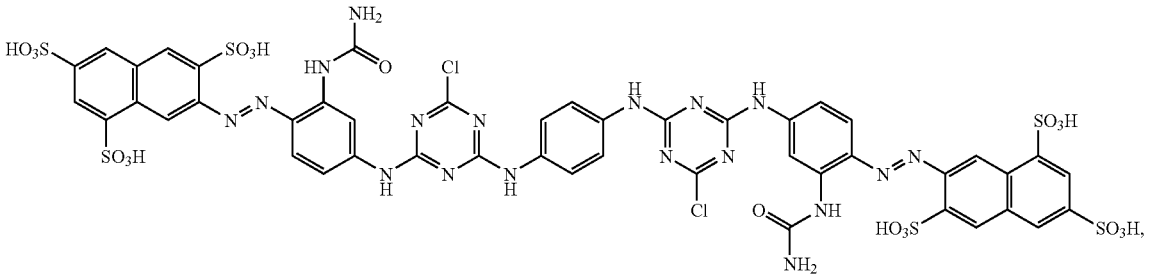
(2.4)
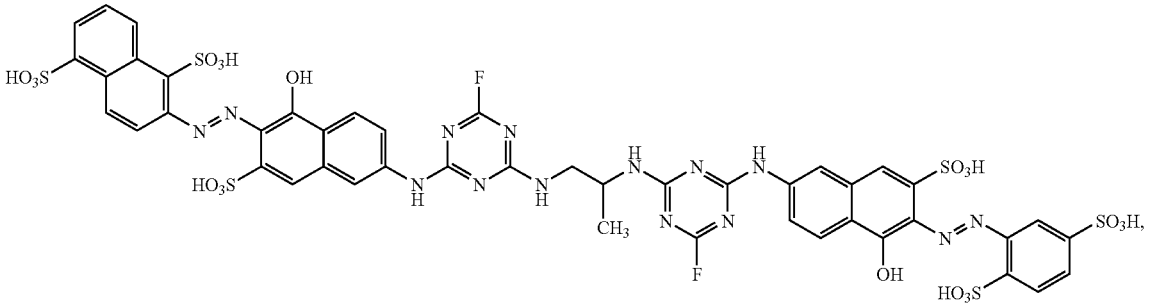
(2.5)
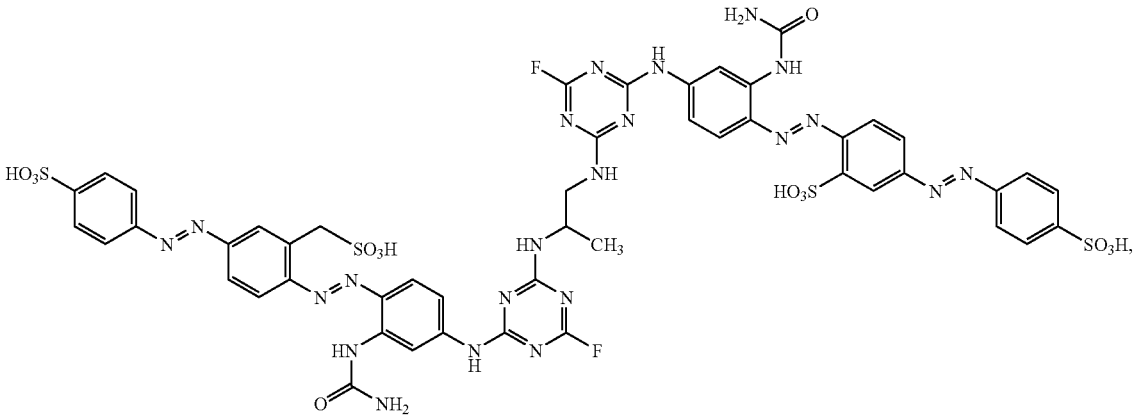
(2.6)
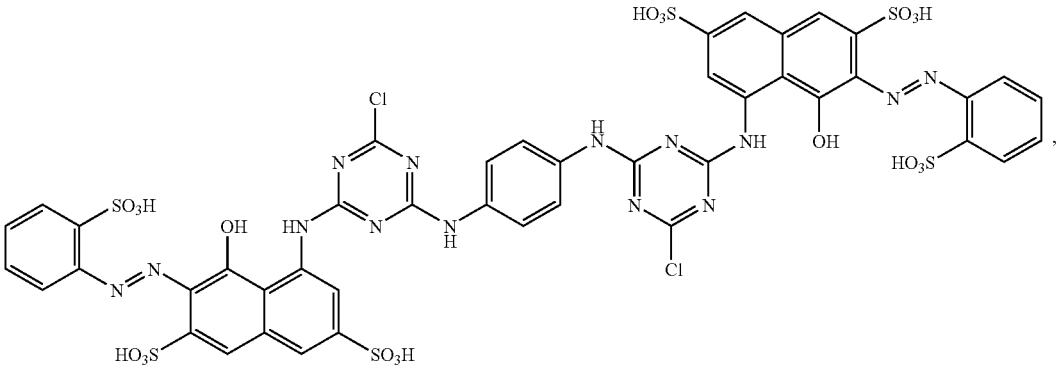

-continued
(2.7)
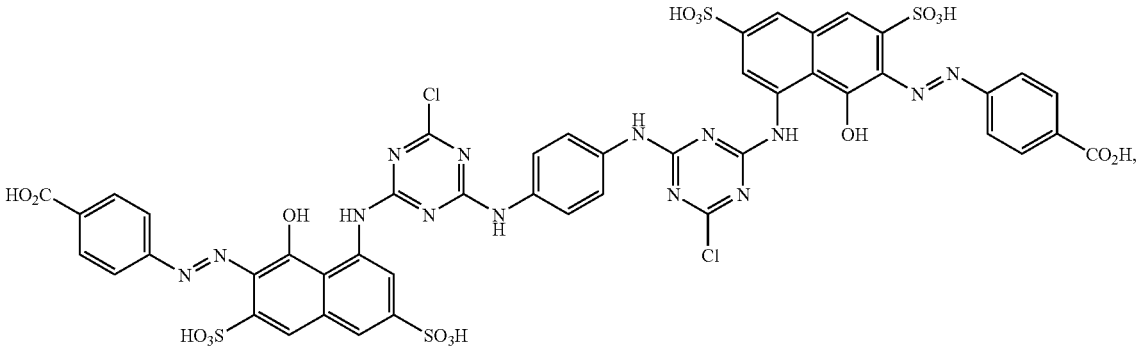
(2.8)
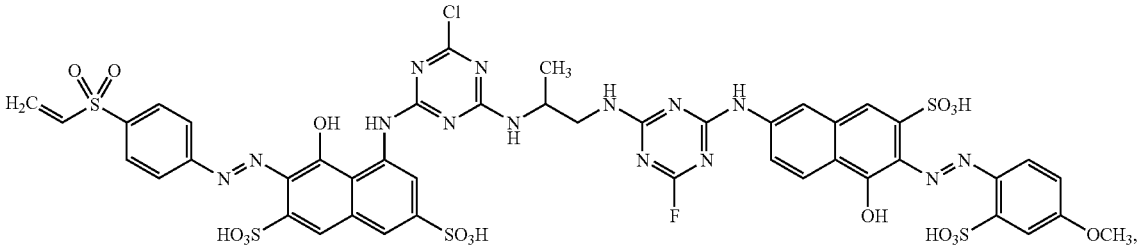
(2.9)
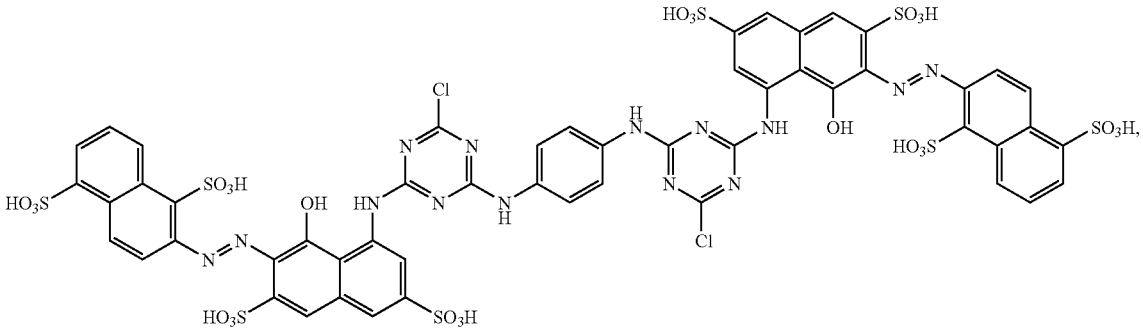
(2.10)
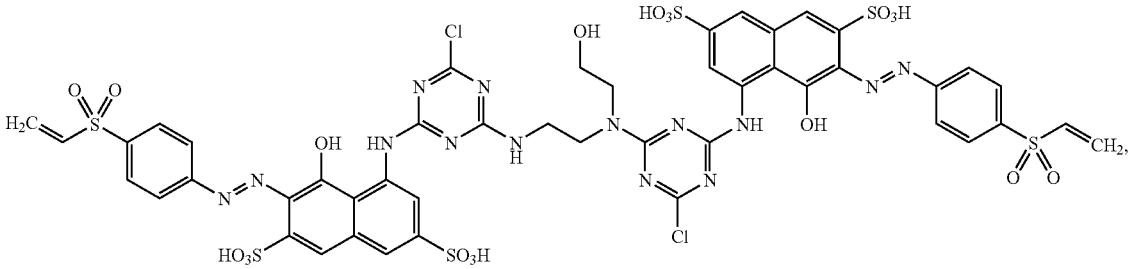

-continued
(2.11)
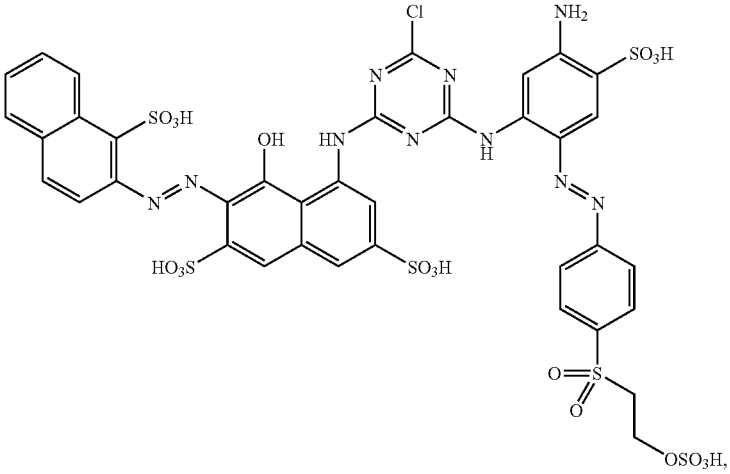
(2.12)
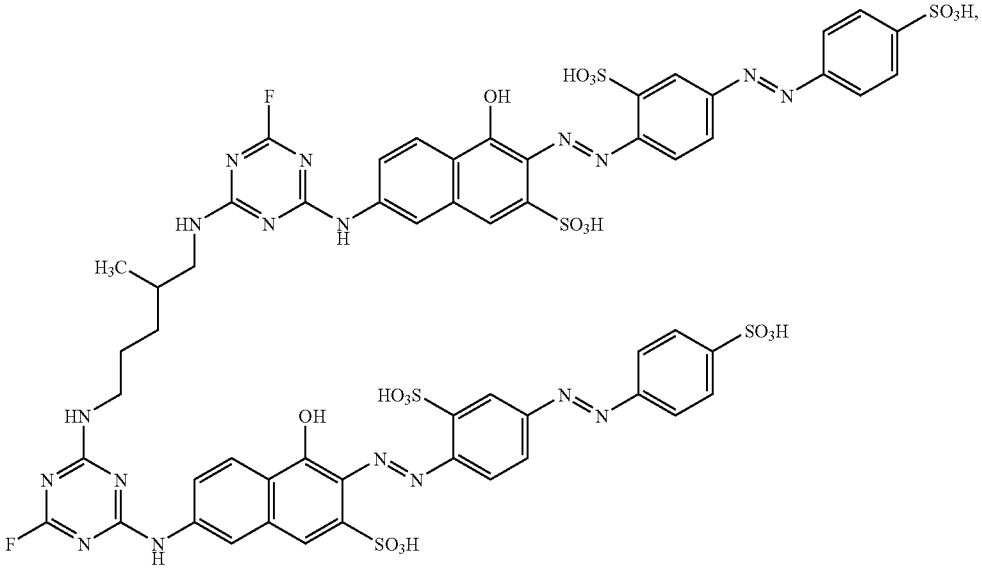
(2.13)
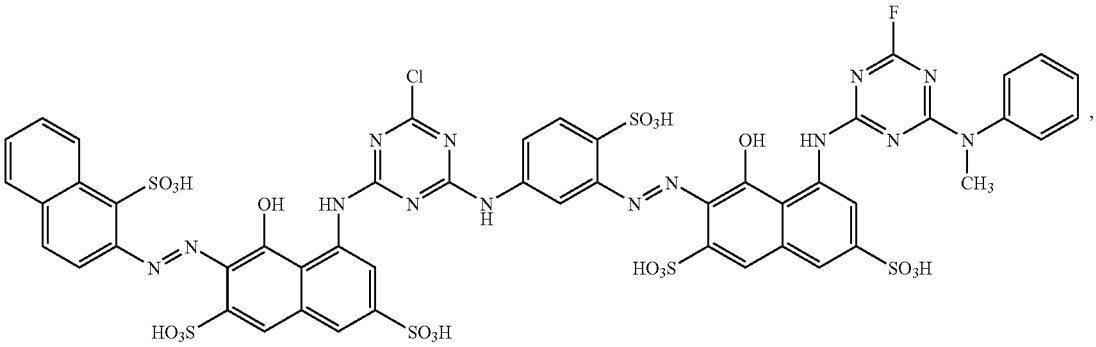

-continued
(2.14)
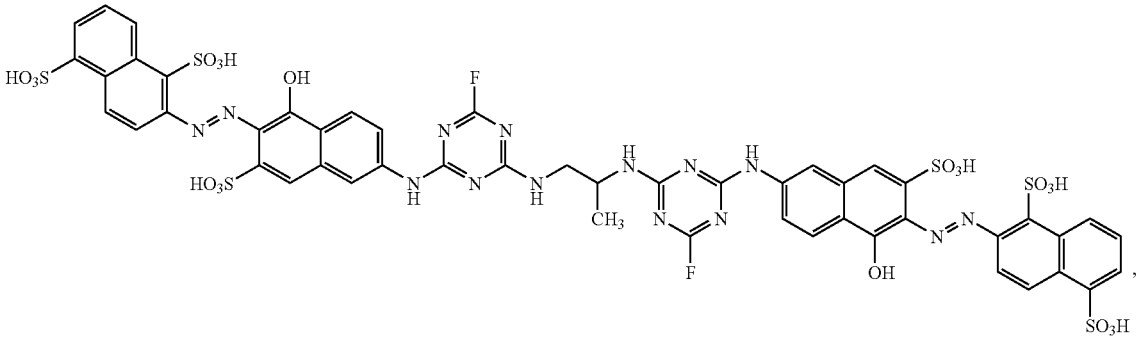
(2.15)
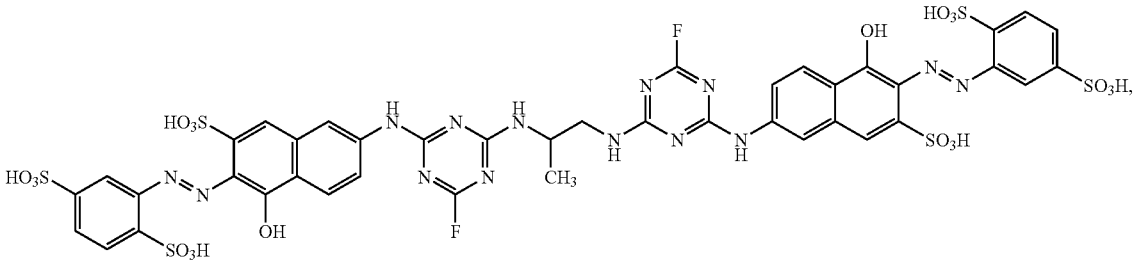
(2.16)
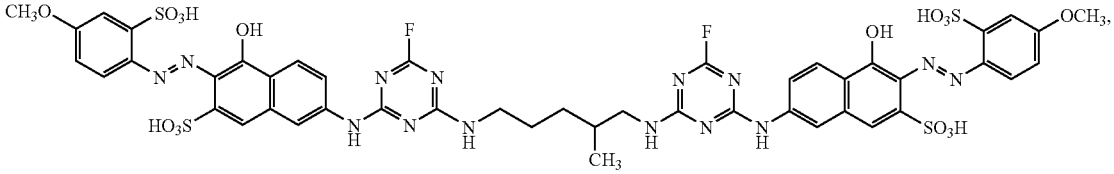
(2.17)
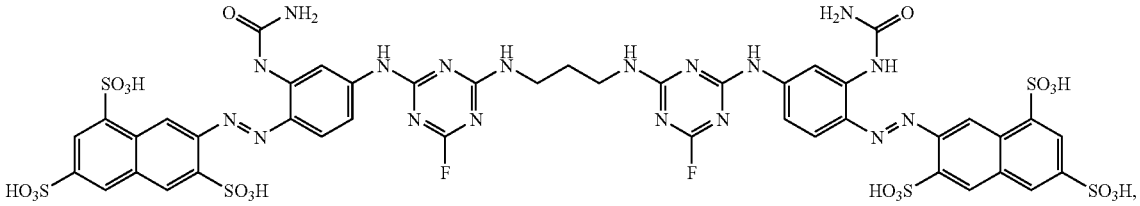
(2.18)
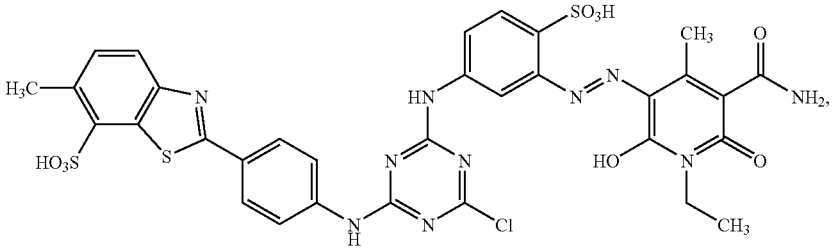

-continued (2.19)

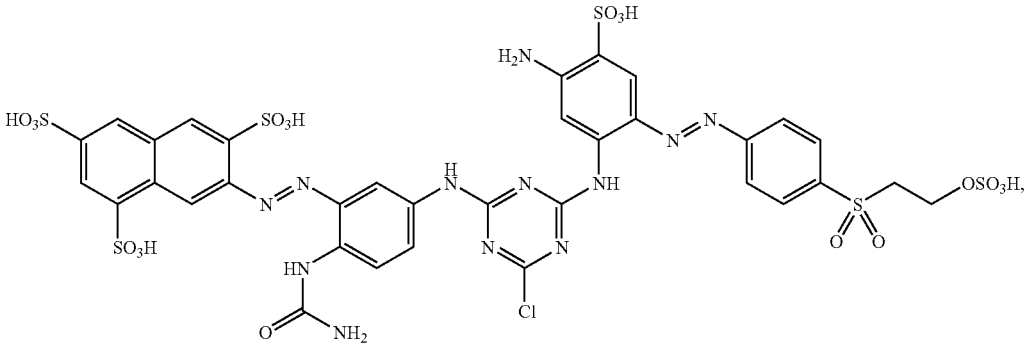

(2.20)

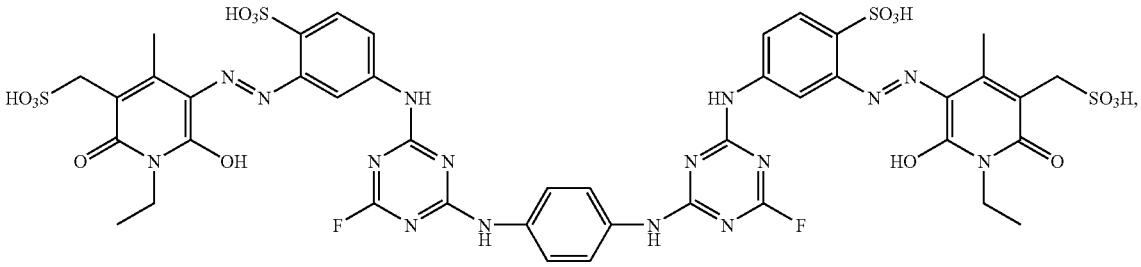

(2.21)

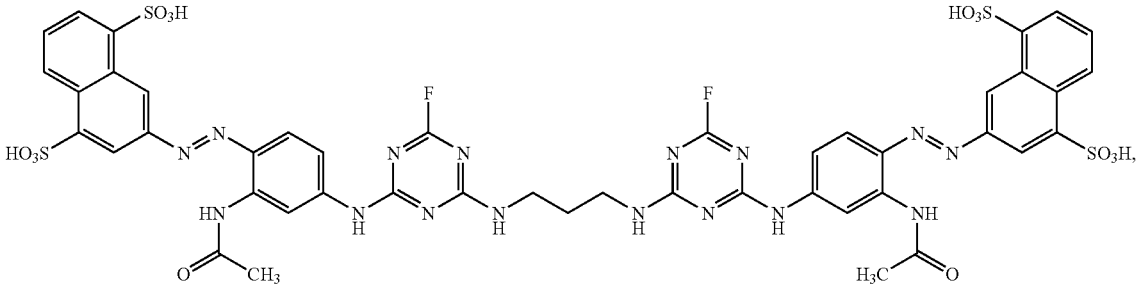

and (2.22)

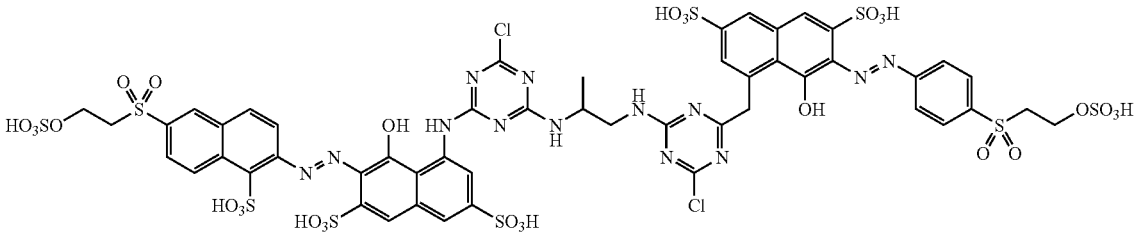

In a particular preferred embodiment of the present invention the dyes of formulae (1.1), (1.4), (1.9), (1.12), (1.14), (1.15), (1.19); (1.23), (1.25), (1.27), (1.29), (1.33), (1.35), (1.39), (1.40). (1.44), (1.45), (1,46) to (1.49), (2.4), (2.14), (2.15) and (2.17) are used.

The reactive dyes of formulae (1) and (2) are known or can be obtained analogously to known compounds, e.g. by customary diazotisation, coupling and condensation reactions.

Preferred as a di, tri or tetramer of a $C_2$-$C_4$-oxyalkylene or a mono- or di-$C_1$-$C_4$-alkyl ether of a $C_2$-$C_4$-Oxyalkylene is a $C_2$-$C_3$-alkylene glycol, for example, diethylene glycol, triethylene glycol, dipropylene glycol, tripropylene glycol, especially dipropylene glycol or tripropylene glycol, more especially dipropylene glycol, in an amount of, for example, from 10 to 60% by weight, preferably from 20 to 50% by weight, especially from 25 to 45% by weight and more especially from 35 to 45% by weight based on the total weight of the ink.

In addition to the components mentioned above, the ink in accordance with the inventive process can contain, as required, various additives such as a surfactants, viscosity adjusting agents, buffers, antifoam agents or substances that inhibit the growth of fungi and/or bacteria, etc.

The inks may comprise thickeners of natural or synthetic origin inter alia for the purpose of adjusting the viscosity.

Examples of thickeners that may be mentioned include commercially available alginate thickeners, starch ethers or locust bean flour ethers, especially sodium alginate on its own or in admixture with modified cellulose, e.g. methylcellulose, ethylcellulose, carboxymethyl-cellulose, hydroxyethylcellulose, methylhydroxyethylcellulose, hydroxypropyl cellulose or hydroxypropyl methylcellulose, especially with preferably from 20 to 25% by weight carboxy-methylcellulose. Synthetic thickeners that may be mentioned are, for example, those based on poly(meth)acrylic acids, poly(meth)acrylamides or polyvinyl pyrrolidones.

The inks comprise such thickeners, for example, in an amount of from 0.01 to 2% by weight, especially from 0.01 to 1.2% by weight and more especially from 0.02 to 1% by weight, based on the total weight of the ink.

With or without such viscosity adjusting agent the viscosity of the ink is adjusted to be from 6 to 14 mPa·s at 25° C., especially from 7 to 12 mPa s at 25° C. and more especially from 8to 11 mPa s at 25° C.

In a particularly preferred embodiment of the present invention poly $C_2$-$C_4$-alkyleneglycol or the mono- or di-$C_1$-$C_4$-alkyl ether of poly $C_2$-$C_4$-alkyleneglycol is used as a viscosity adjusting agent, the alkylene moieties of which nay be straight chained or branched, especially poly $C_2$-$C_3$-alkyleneglycol, such as, polyethylene glycol, polypropylene glycol or a mixed ethylene oxide/propylene oxide copolymerisate, and more especially a mixed ethylene oxide/propylene oxide copolymerisate. The molar mass is, for example, from 1,000 to 35,000 g/mol, preferably from 2,000 to 25,000 g/mol and especially from 3,000 to 20,000. The said compounds are commercially available, for example, as P41-type polyglycols (Clariant).

The organic solvent (II) is used solely, although alternatively, a mixture of two or more organic solvents may be used. Further organic solvents which may be used in combination with component (II) are water-miscible organic solvents, for example $C_1$-$C_4$-alcohols, such as methanol, ethanol, n-propanol, isopropanol, n-butanol, sec-butanol, tert-butanol and iso-butanol; amides, e.g. dimethylformamide and dimethylacetamide; ketones or ketone alcohols, e.g. acetone and diacetone alcohol; ethers, e.g. tetrahydrofuran and dioxane; nitrogen-containing heterocyclic compounds, e.g. N-methyl-2-pyrrolidone and 1,3-dimethyl-2-imidazolidone; glycols or thioglycols, e.g. ethylene glycol, propylene glycol, butylene glycol, thiodiglycol and hexylene glycol; further polyols, e.g. glycerol and 1,2,6-hexanetriol; and $C_1$-$C_4$alkyl ethers of polyhydric alcohols, e.g. 2-methoxyethanol, 2-(2-ethoxyethoxy)ethanol, 2-(2-ethoxyethoxy)ethanol, 2-[2-(2-methoxyethoxyethoxy]-ethanol and 2-[2-(2-ethoxyethoxy)-ethoxy]ethanol; preferably N-methyl-2-pyrrolidone, glycerol or especially 1,2-propylene glycol.

Preferably, the organic solvent (II) is used solely without any further organic solvent.

The inks may also comprise solubilisers, e.g. ε-caprolactam.

The inks may also comprise buffer substances. e.g. borax, borates, phosphates, poly-phosphates or citrates. Examples that may be mentioned include borax, sodium borate, sodium tetraborate, sodium dihydrogen phosphate, disodium hydrogen phosphate, sodium tripolyphosphate, sodium pentapolyphosphate and sodium citrate. They are used especially in amounts of from 0.1 to 3% by weight, preferably from 0.1 to 1% by weight, based on the total weight of the ink, in order to establish a pH value, for example, from 4 to 10, especially from 5 to 9.5 and more especially from 8 to 9.

As further additives, the inks may comprise surfactants or humectants.

Suitable surfactants include commercially available anionic or non-ionic surfactants. As humectants in the inks according to the invention there come into consideration, for example, urea or a mixture of sodium lactate (advantageously in the form of a 50% to 60% aqueous solution) and glycerol and/or propylene glycol in amounts of preferably from 0.1 to 30% by weight, especially from 2 to 30% by weight The inks in addition may contain the sodium salt of nitrobenzene sulfonic acid.

The inks may also comprise customary additives, such as antifoam agents or especially substances that inhibit the growth of fungi and/or bacteria. Such additives are usually used in amounts of from 0.01 to 1% by weight, based on the total weight of the ink.

As preservatives there come into consideration formaldehyde-releasing agents. e.g. paraformaldehyde and trioxane, especially aqueous, for example 30 to 40% by weight formaldehyde solutions, imidazole compounds, e.g. 2-(4-thiazolyl)benzimidazole, thiazole compounds, e.g. 1,2-benzisothiazolinone or 2-n-octyl-isothiazolin-3-one, iodine compounds, nitriles, phenols, haloalkylthio compounds and pyridine derivatives, especially 1,2-benzisothiazolin-3one or 2-n-octyl-isothiazolin-3-one. As an example for a broad spectrum biocide for the preservation against spoilage from bacteria, yeasts and fungi a 20% by weight solution of 1,2benzisothiazolin-3one in dipropylene glycol (Proxel™ GXL) can be used.

The inks may comprise further ingredients such as fluorinated polymers or telomers for example polyethoxy perfluoro alcohols (Forafac® products) in an amount of from 0.01 to 1% by weight based on the total weight of the ink.

It is preferred that the surface tension is adjusted to range from 20 to 40 dyne/cm at 25° C., especially from 20 to 35 dyne/cm at 25° C. and more especially from 25 to 30 dyne/cm at 25° C.

Furthermore it is preferred that the conductivity of the ink is adjusted to range from 1 to 6 mS/cm at 25° C. and especially from 2 to 5 mS/cm at 25° C.

The inks can be prepared in customary manner by mixing the individual constituents together in the desired amount of water.

It has been found that the inks described above can be advantageously applied to the textile fiber materials by means of an ink-jet printing device provided with at least one ink-jet print head which comprises a nozzle layer (a) defining a plurality of ejection nozzles, an ink supply layer (b) which is formed from a porous material having a multitude of small interconnected pores so as to allow passage of ink therethrough, the ink supply layer featuring a plurality of connecting bores (holes) from the rear surface to the front surface, each connecting bore being aligned so as to connect between a corresponding one of the ejection nozzles and a deflection layer (c), comprising a plurality of transducers related to the connecting bores for ejecting ink droplets out through the nozzles.

The ink-jet print head applied in accordance with the present invention may additionally comprise an ink cavity layer (d), associated with the rear surface of the ink supply layer (b) having a plurality of apertures, each aperture being positioned to correspond to one of the connecting bores of the ink supply layer so as to at least partially define a corresponding ink cavity.

The ink-jet print head applied in accordance with the present invention comprises a layered structure a key element of which is the ink supply layer (b) made of a porous material. The ink supply layer (b) is in direct communication with both the ink reservoir and the individual ink cavities of the connecting bores (holes) and/or the individual ink cavities of the ink cavity layer (d), thereby acting as hydraulic linkage between the ink main supply and the individual ink cavities.

The porous material includes, for example, sintered material, most preferably, sintered stainless steel.

The ink cavity layer (d) may be omitted. In this case, the deflection layer directly adjoins the ink supply layer.

The ink-jet print head used in accordance with the present invention is described in detail in U.S. Pat. No. 5,940,099, the disclosure of which is incorporated herein.

The ink-jet print head applied in accordance with the present invention belongs to the category of drop on demand systems, wherein the ink drops are ejected selectively as required.

The transducers are, for example, piezoelectric crystals (piezoelectric type) or thermoelectric elements (thermal bubble jet type), preferably piezoelectric crystals.

The ejection of ink drops using a device according to one embodiment of the present invention is accomplished as follows:

A pressure pulse is imparted to a volume of ink in an ink cavity through the deflection of a thin deflection plate, or diaphragm, located on top of the ink cavity. The plate is deflected downward by the action of a piezoceramic crystal whenever a voltage is applied across its electrodes, one of which is in electrical contact with the usually metallic deflection plate. The pressure pulse created by the downward bending of the deflection plate drives the ink towards and through an outlet, having a convergent nozzle at its outlet end, causing the ejection of a drop of a specific size. When the piezoelectric crystal is de-energized, it returns to its equilibrium position, reducing the pressure in the ink cavity and causing the meniscus at the outlet end to retract. The retracted meniscus generates a capillary force which acts to pull ink from an ink reservoir through the porous material of the ink supply layer (b) into the ink cavity and into the connecting bores (holes) related to the nozzle. The refilling process ends when the meniscus regains its equilibrium position.

The micron grade and the surface area of the porous material which is open for flow into the ink cavity has a crucial impact on the refill time of the ink cavities and hence on the maximum drop ejection rate, or frequency. The ink according to the inventive process moves through the interconnected pores and channels of the ink supply layer (b) with suitable flow resistances in order to realize system performance which allows for high ejection frequencies, for example, 5 to 100 kHz, preferably 10 to 50 kHz and especially 20 to 40 kHz Moreover the inks cause no dogging of the ejection nozzles. Feathering or blurring and blotting on the both is omitted. The inks are storage stable, i.e. no deposition of solid matter is observed in the course of storage.

Further embodiments of suitable inkjet print head configurations comprising an ink supply layer which is formed from a porous material are described in U.S. Pat. No. 5,940,099, all of which can be used in the process according to the present invention.

In a preferred embodiment of the present invention the ink-jet print head comprises a nozzle layer (a) defining a plurality of ejection nozzles, an ink supply layer (b) having a front surface associated with the nozzle layer and a rear surface associated with a cavity layer (d), the ink supply layer being formed with a plurality of connecting bores (holes) from the rear surface to the front surface, each connecting bore being aligned so as to connect between a corresponding one of the ink cavities and a corresponding one of the ejection nozzles, wherein the ink supply layer additionally features (i) a pattern of ink distribution channels formed in the front surface, and (ii) at least one ink inlet bore passing from the rear surface to the front surface and configured so as to be in direct fluid communication with at least part of the pattern of ink distribution channels, the pattern of ink distribution channels and the at least one ink inlet bore together defining part of an ink flow path which passes from the rear surface through the at least one ink inlet bore to the pattern of ink distribution channels on the front surface, and through the porous material to the plurality of ink cavities.

a deflection layer (c), comprising a plurality of transducers related to the connecting bores for ejecting ink droplets out through the nozzles.

The location of ink distribution channels on the front surface ensures that ink flow through the porous material of ink supply layer occurs through the bulk of the layer. Preferably ink distribution channels are distributed over the front surface in such a pattern that each connecting bore is approximately the same distance from its nearest ink distribution channel. In the typical case that the connecting bores define an array on the front surface having two row directions, the pattern of ink distribution channels preferably includes a plurality of channels deployed substantially parallel to one of the row directions and interposed between adjacent rows of the connecting bores. The ink flow path is particularly effective for providing a sufficient and generally uniform ink supply to the porous layer across an entire array of ink cavities.

The ink-jet print head used in accordance with the present invention is a multi-nozzle print head, the individual nozzles of which are advantageously arranged as an array made up of horizontal rows which are horizontally staggered, or skewed, with respect to one another, comprising, for example, 512 nozzles staggered in a 32×16 array.

The ink-jet print head used in accordance with the preferred embodiment of the present invention is described in detail in U.S. Pat. No. 6,439,702, the disclosure of which is incorporated herein.

Further embodiments of suitable ink-jet print head configurations comprising an ink supply layer which is formed from a porous material are described in U.S. Pat. No. 6,439,702, all of which can be used in the process according to the present invention.

The ink-jet printing device used in accordance with the present invention comprises at least one of the inkjet print heads described above. Preferably, the printing device uses at least 3 process colors, for example 3, 4, 5 or 6 process colors, preferably 6 process colors, wherein each color is processed with at least one print head, for example 1, 2, 3, 4, 5, 6 or 7 printing heads, preferably 7 printing heads.

The present invention allows textile fiber materials to be printed with a speed of at least 50 $m^2/h$, preferably in the range of 100 to 250 $m^2/h$, especially 150 to 250 $m^2/h$.

Textile fibre materials that come into consideration are especially hydroxy-group-containing fibre materials. Preference is given to cellulosic fibre materials that consist wholly or partly of cellulose. Examples are natural fibre materials, such as cotton, linen and hemp, and regenerated fibre materials, for example viscose and lyocell. Special preference is given to viscose and cotton, especially cotton. The said fibre materials are preferably in the form of textile woven fabrics, knitted fabrics or webs.

According to a preferred embodiment of the present invention, prior to printing the fibre material is subjected to a pretreatment in which the fibre material to be printed is first treated with an aqueous alkaline liquor and the treated fibre material is optionally dried. The aqueous alkaline liquor comprises at least one of the customary bases used for fixing the reactive dyes in conventional reactive printing processes. The base is used, for example, in an amount of from 10 to 100 g/l of liquor, preferably from 10 to 50 g/l of liquor. Suitable bases are, for example, sodium carbonate, sodium hydroxide, disodium phosphate, trisodium phosphate, sodium acetate, sodium propionate, sodium hydrogen carbonate, aqueous ammonia or sources of alkali, such as sodium chloroacetate or sodium formate. It is preferable to use sodium hydrogen carbonate, sodium carbonate or a mixture of water glass and sodium carbonate. The pH value of the alkaline liquor is generally from 7.5 to 13.5, preferably from 8.5 to 12.5. In addition to the bases, the aqueous alkaline liquor may also comprise further additives, e.g. hydrotropic agents. The hydrotropic agent preferably used is urea, which is used, for example, in an amount of from 25 to 200 g/l of liquor, preferably from 50 to 150 g/l of liquor. In addition the liquor for pretreating the fibre material may contain the sodium salt of nitrobenzene sulfonic acid in an amount of 1 to 100 g/l of liquor and a copolymer of acrylamide basis in an amount of 50 to 500 g/l of liquor as well as a silicon based softener, for example a Megasoft® product in an amount of 0,1 to 100 g/l of liquor.

An excellent colour performance is obtained with the following pre-treatment of the fibre material, which is a further object of the invention, whereby the fabric is pre-treated, for example by printing or padding or jet dyeing , preferably pad-dyed with the liquor comprising a pad dyeing auxiliary comprising acrylic acid amide/acrylic acid copolymer from acrylic acid amide and acrylic acid monomer in an amount of 0.5 to 5 g/l of liquor, urea in an amount of 50 to 150 g/l of liquor, a base, preferably soda ash, in an amount of 20 to 80 g/l of liquor, sodium salt of nitrobenzene sulfonic acid in an amount of 5 to 50 g/l of liquor, a softener based on a amino functional siloxane in an amount of 10 to 100 g/l of liquor and optionally a salt, preferably sodium chloride, in an amount of 50 to 200 g/l of liquor.

Preferably the fibre material is dried after the above pretreatment

After printing, the fibre material is advantageously dried, preferably at temperatures of up to 150° C., especially from 80 to 120° C., and then, where necessary, subjected to a heat treatment process in order to complete the print, that is to say to fix the dye.

The heat treatment can be carried out, for example, by means of a hot batch process, a thermosol process or, preferably, by means of a steaming process.

In the case of the steaming process the printed fibre material is subjected, for example, to treatment in a steamer with steam which is optionally superheated, advantageously at a temperature of from 95 to 180° C., more especially in saturated steam.

Subsequently the printed fibre material is generally washed off with water in customary manner in order to remove unfixed dye.

Using the printing processes indicated above it is possible to print fibrous materials either in a single shade or in a variety of shades. When the printing is in one shade, the fibrous material can be printed over the entire surface or with a pattern. The use of a single ink is, of course, sufficient for that purpose, but the desired shade can also be created by printing with a plurality of inks of different shades. When the fibrous material is to receive a print having a plurality of different shades, the fibrous material can either be printed with a plurality of inks that each have the desired shade or printed in such a manner that the shade in question is created (for example by printing the fibrous material with inks of different shades one on top of another, thus producing the required shade).

The prints produced are distinguished especially by a high tinctorial strength and a high color brilliance as well as by good light-fastness and wet-fastness properties.

The present invention relates also to an aqueous inks comprising (I) at least one fiber reactive dye of formula (1) or (2), and (II) a di, tri or tetramer of a $C_2$-$C_4$-oxyalkylene or a mono- or di-$C_1$-$C_4$-alkyl ether of a di, tri or tetramer of a $C_2$-$C_4$-oxyalkylene, said ink having a viscosity from 5 to 20 mPa s at 25° C., wherein the variables associated with components (I) and (II) have the meanings and preferences given above.

The following Examples serve to illustrate the invention. Unless otherwise indicated, the temperatures are given in degrees Celsius, parts are parts by weight and percentages relate to percent by weight. Parts by weight relate to parts by volume in a ratio of kilograms to liters.

EXAMPLE 1 a) Mercerised cotton satin fabric web is pad-dyed with a liquor comprising 30 g/l of sodium carbonate (liquor pick-up 70%) and dried.

b) The cotton satin pretreated in accordance with step a) is printed with an industrial piezoelectric drop on demand inkjet printing device (Reggiani DReAM) at a speed of 150 $m^2$/h. The device processes 6 colors (6 inks), wherein each process color is printed with 7 print heads (Aprion).

The inks are as follows:

a yellow aqueous ink containing:
- 6.5% by weight of the reactive dye of formula (1.45),
- 40.0% by weight of dipropylenglycol,
- 0.5% by weight of polyglycol (ethylene oxide/propylene oxide copolymerisate, branched),
- 0.3% by weight of Proxel™ GXL,
- 52.7% by weight of water;

an orange aqueous ink containing:
- 7.0% by weight of the reactive dye of formula (1.29),
- 40.0% by weight of dipropylenglycol,
- 0.4% by weight of polyglycol (ethylene oxide/propylene oxide copolymerisate, branched),
- 0.3% by weight of Proxel™ GXL,
- 52.3% by weight of water, a red aqueous ink containing:
- 10.0% by weight of the reactive dye of formula (1.35),
- 40.0% by weight of dipropylenglycol,
- 0.3% by weight of Proxel™ GXL,
- 49.7% by weight of water, a blue aqueous ink containing:
- 9.0% by weight of the reactive dye of formula (1.9),
- 40.0% by weight of dipropylenglycol,
- 0.3% by weight of Proxel™ GXL,
- 50.7% by weight of water;

a turquoise aqueous ink containing:
- 7.5% by weight of the reactive dye of formula (1.40),
- 40.0% by weight of dipropylenglycol,
- 0.4% by weight of polyglycol (ethylene oxide/propylene oxide copolymerisate, branched),
- 0.3% by weight of Proxel™ GXL,
- 51.8% by weight of water, a black aqueous ink containing:
- 0.2% by weight of the reactive dye of formula (1.14),
- 10.6% by weight of the reactive dye of formula (1.23),
- 40.0% by weight of dipropylenglycol, 0.3% by weight of Proxel™ GXL,
48.9% by weight of water.

The print is dried on line with an integrated hot air dryer at 100° C. A high quality multicolour print showing no blotting and having very good fastness to washing is obtained.

EXAMPLE 2

For an excellent performance the above given example 1 is repeated using the following steps:

a) Mercerised cotton satin fabric web is pad-dyed with a liquor comprising 2 g/l of a pad dyeing auxiliary comprising acrylic acid amide/acrylic add copolymer from acrylic add amide and acrylic acid monomer, 100 g/l of urea, 40 g/l soda ash, 100 g/l of sodium chloride, 20 g/l of sodium salt of nitrobenzene sulfonic add and 30 g/l of a softener based on a amino functional siloxane (liquor pick-up 70%) and dried.

b) The cotton satin pretreated in accordance with step a) is printed with an industrial piezoelectric drop on demand ink-jet printing device (Reggiani DReAM) at a speed of 150 $m^2$/h. The device processes 6 colors (6 inks), wherein each process color is printed with 7 print heads (Aprion).

The inks are as follows:

a yellow aqueous ink containing:
6.5% by weight of the reactive dye of formula (1.45),
40.0% by weight of dipropylenglycol,
0.5% by weight of polyglycol (ethylene oxide/propylene oxide copolymerisate, branched),
0.3% by weight of Proxel™ GXL,
0.1% by weight of a polyethoxy perfluoro alcohol (e.g. Forafac® 1110 D)
52.6% by weight of water;

an orange aqueous ink containing:
7.0% by weight of the reactive dye of formula (1.29),
40.0% by weight of dipropylenglycol,
0.04% by weight of polyglycol (ethylene oxide/propylene oxide copolymerisate, branched),
0.3% by weight of Proxel™ GXL,
52.3% by weight of water;

a red aqueous ink containing:
10.0% by weight of the reactive dye of formula (1.35),
40.0% by weight of dipropylenglycol,
0.3% by weight of Proxel™ GXL,
0.1% by weight of a polyethoxy perfluoro alcohol (e.g. Forafac® 1110D)
49.6% by weight of water;

a blue aqueous ink containing:
9.0% by weight of the reactive dye of formula (1.9),
40.0% by weight of dipropylenglycol,
0.3% by weight of Proxel™ GXL,
50.7% by weight of water;

a turquoise aqueous ink containing:
7.5% by weight of the reactive dye of formula (1.40),
40.0% by weight of dipropylenglycol,
0.4% by weight of polyglycol (ethylene oxide/propylene oxide copolymerisate, branched),
0.3% by weight of Proxel™ GXL,
0.1% by weight of a polyethoxy perfluoro alcohol (e.g. Forafac® 1110D)
51.7% by weight of water, a black aqueous ink containing:
0.2% by weight of the reactive dye of formula (1.14),
10.6% by weight of the reactive dye of formula (1.23),
40.0% by weight of dipropylenglycol,
0.3% by weight of Proxel™ GXL,
0.1% by weight of a polyethoxy perfluoro alcohol (e.g. Forafac® 1110D)
48.8% by weight of water.

The print is dried on line with an integrated hot air dryer at 100° C. A high quality multicolour print showing no blotting and having very good fastness to washing is obtained.

EXAMPLE 3 a) Causticized woven viscose fabric web is pad-dyed with a liquor comprising 30 g/l of sodium carbonate and 100 g/l of urea (liquor pick-up 70%) and dried.

b) The causticized woven viscose fabric pretreated in accordance with step a) is printed with an industrial piezoelectric drop on demand ink-jet printing device (Reggiani DReAM) at a speed of 150 $m^2$/h in analogy to the process of example 1 using the inks of example 1. The print is dried on line with an integrated hot air dryer at 100° C. A high quality multicolour print showing no blotting and having very good fastness to washing is obtained.

EXAMPLE 4 a) Mercerised cotton satin fabric web is pad-dyed with a liquor comprising 30 g/l of sodium carbonate (liquor pick-up 70%) and dried.

b) The cotton satin pretreated in accordance with step a) is printed with an industrial piezoelectric drop on demand ink-jet printing device (Reggiani DReAM) at a speed of 150 $m^2$/h. The device processes 6 colors (6 inks), wherein each process color is printed with 7 print heads (Aprion).

The inks are as follows:

a yellow aqueous ink containing:
6.8% by weight of the reactive dye of formula (1.44),
40.0% by weight of dipropylenglycol,
0.3% by weight of polyglycol (ethylene oxide/propylene oxide copolymerisate, branched),
0.3% by weight of Proxel™ GXL,
0.1% by weight of a polyethoxy perfluoro alcohol (e.g. Forafac® 1110D)
52.5% by weight of water;

an orange aqueous ink containing:
7.2% by weight of the reactive dye of formula (1.27),
41.0% by weight of dipropylenglycol,
0.3% by weight of Proxel™ GXL,
0.3% by weight of polyglycol (ethylene oxide/propylene oxide copolymerisate, branched)
0.1% by weight of a polyethoxy perfluoro alcohol (e.g. Forafac® 1110D)
51.1% by weight of water;

a red aqueous ink containing:
8.0% by weight of the reactive dye of formula (1.33),
40.0% by weight of dipropylenglycol,
0.2% by weight of polyglycol (ethylene oxide/propylene oxide copolymerisate, branched)
0.3% by weight of Proxel™ GXL,
0.1% by weight of a polyethoxy perfluoro alcohol (e.g. Forafac® 1110D)
51.4% by weight of water;

a blue aqueous ink containing:
9.0% by weight of the reactive dye of formula (1.4),
38.0% by weight of dipropylenglycol,
0.3% by weight of Proxel™ GXL,
0.1% by weight of a polyethoxy perfluoro alcohol (e.g. Forafac® 1110D)
52.6% by weight of water;

a turquoise aqueous ink containing:

7.5% by weight of the reactive dye of formula (1.39), 40.0% by weight of dipropylenglycol, 0.4% by weight of polyglycol (ethylene oxide/propylene oxide copolymerisate, branched), 0.3% by weight of Proxel™ GXL, 0.1% by weight of a polyethoxy perfluoro alcohol (e.g. Forafac® 1110D)

51.7% by weight of water, a black aqueous ink containing:

0.3% by weight of the reactive dye of formula (1.25), 10.0% by weight of the reactive dye of formula (1.1), 38.0% by weight of dipropylenglycol, 0.3% by weight of Proxel™ GXL, 0.1% by weight of a polyethoxy perfluoro alcohol (e.g. Forafac® 1110D)

51.3% by weight of water.

The print is dried on line with an integrated hot air dryer at 100° C. A high quality multicolour print showing no blotting and having very good fastness to washing is obtained.

EXAMPLE 5 a) Causticized woven viscose fabric web is pad-dyed with a liquor comprising 30 g/l of sodium carbonate and 100 g/l of urea (liquor pickup 70%) and dried.

b) The cotton satin pretreated in accordance with step a) is printed with an industrial piezoelectric drop on demand ink-jet printing device (Reggiani DReAM) at a speed of 150 $m^2$/h. The device processes 6 colors (6 inks), wherein each process color is printed with 7 print heads (Aprion).

The inks are as follows:

a yellow aqueous ink containing:

10% by weight of the reactive dye of formula (2.17), 41.0% by weight of dipropylenglycol, 0.3% by weight of Proxel™ GXL, 0.1% by weight of a polyethoxy perfluoro alcohol (e.g. Forafac® 1110D)

46.6% by weight of water;

an orange aqueous ink containing:

8.0% by weight of a mixture of the reactive dyes of formula (2.4), (2.14) und (2.15)

39.0% by weight of dipropylenglycol, 0.4% by weight of polyglycol (ethylene oxide/propylene oxide copolymerisate, branched), 0.3% by weight of Proxel™ GXL, 0.1% by weight of a polyethoxy perfluoro alcohol (e.g. Forafac® 1110D)

52.2% by weight of water;

a red aqueous ink containing:

8.0% by weight of the reactive dye of formula (2.22), 40.0% by weight of dipropylenglycol, 0.3% by weight of polyglycol (ethylene oxide/propylene oxide copolymerisate, branched), 0.3% by weight of Proxel™ GXL, 0.1% by weight of a polyethoxy perfluoro alcohol (e.g. Forafac® 1110D), 51.3% by weight of water;

a blue aqueous ink containing:

9.0% by weight of the reactive dye of formula (1.12), 42.0% by weight of dipropylenglycol, 0.3% by weight of Proxel™ GXL, 0.1% by weight of a polyethoxy perfluoro alcohol (e.g. Forafac® 1110D)

48.6% by weight of water;

a turquoise aqueous ink containing:

7.5% by weight of the reactive dye of formula (1.40), 40.0% by weight of dipropylenglycol, 0.4% by weight of polyglycol (ethylene oxide/propylene oxide copolymerisate, branched), 0.1% by weight of a polyethoxy perfluoro alcohol (e.g. Forafac® 1110D)

0.3% by weight of Proxel™ GXL, 51.7% by weight of water, a black aqueous ink containing:

1.5% by weight of a mixture of the reactive dyes of formula (1.46), (1.47), (1.48) and (1.49), 1.5% by weight of the reactive dye of formula (1.50), 7.0% by weight of the reactive dye of formula (1.1), 40.0% by weight of dipropylenglycol, 0.3% by weight of Proxel™ GXL, 0.1% by weight of a polyethoxy perfluoro alcohol (e.g. Forafac® 1110D)

49.6% by weight of water.

The print is dried on line with an integrated hot air dryer at 100° C. A high quality multicolour print showing no blotting and having very good fastness to washing is obtained.

What is claimed is:

1. An ink-jet printing process for printing textile fiber materials, wherein the fiber materials are printed with an aqueous ink comprising (I) at least one fiber reactive dye, and (II) a di, tri or tetramer of a $C_2$-$C_4$-oxyalkylene or a mono- or di-C1-C4-alkyl ether of a di, tri or tetramer of a $C_2$-$C_4$-oxyalkylene, said ink having a viscosity from 5 to 20 mPa s at 25°C, and wherein said ink is applied to the fiber material with an ink-jet print head comprising an ink supply layer (b) receiving ink from an external ink reservoir, said ink supply layer having a first side and a second side and comprising, a porous medium having a plurality of pores therein and a plurality of holes extending therethrough, so as to allow passage of the ink and wherein the textile fiber material is pre-treated with a liquor comprising a pad dyeing auxiliary comprising a copolymer from acrylic acid amide and acrylic acid monomer in an amount of 0.5 to 5 g/l of liquor, urea in an amount of 50 to 150 g/l of liquor, a base in an amount of 20 to 80 g/l of liquor, the sodium salt of a nitrobenzene sulfonic acid in an amount of 5 to 50 g/l of liquor, a softener based on a amino functional siloxane in an amount of 10 to 100 g/l of liquor and optionally a salt, in an amount of 50 to 200 g/l of liquor.

2. A process according to claim 1, wherein the fiber reactive dye is a dye of the formula $$A_1\text{-}(Z_1)_{1\text{-}3} \qquad (1),$$

wherein $A_1$ is the radical of a monoazo, disazo, polyazo, metal-complexed azo, anthraquinone, phthalocyanine, formazan or dioxazine chromophore having at least one sulfo group, and $(Z_1)_{1\text{-}3}$ is 1 to 3 identical or different fiber reactive radicals, or a dye of the formula (2)

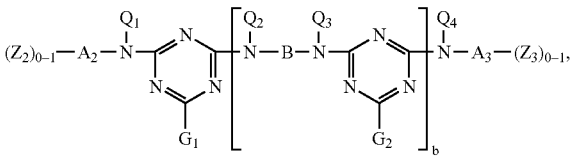

wherein $Q_1$, $Q_2$, $Q_3$ and $Q_4$ are each independently of the others hydrogen or unsubstituted or substituted $C_1$-$C_4$alkyl, $G_1$ und $G_2$ are halogen, B is an organic bridge member, $A_2$ and $A_3$ are each independently of the other as defined for $A_1$, or one of $A_2$ and $A_3$ is hydrogen or unsubstituted or substituted $C_1$-$C_4$alkyl, phenyl or naphthyl and the other one of $A_2$ and $A_3$ is as defined for $A_1$, $(Z_2)_{0-1}$ and $(Z_3)_{0-1}$ are each independently of the other 0 or 1 identical or different fiber reactive radicals, and b is the number 0 or 1.

3. A process according to claim 2, wherein $Z_1$, $Z_2$ and $Z_3$ are each independently of the other a radical of the formula (3a)

$$—SO_2—Y,$$

(3b)

$$—NH—CO—(CH_2)_l—SO_2—Y,$$

(3c)

$$—CONR_2—(CH_2)_m—SO_2—Y,$$

(3d)

$$—NH—CO—CH(Hal)—CH_2—Hal,$$

(3e)

$$—NH—CO—C(Hal)=CH_2,$$

(3f)

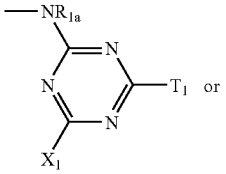

(3g)

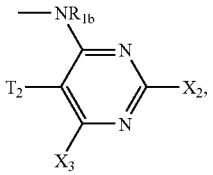

in which

Hal is chlorine or bromine;

$X_1$ is halogen, 3-carboxypyridin-1-yl or 3-carbamoylpyridin-1-yl;

$T_1$ independently has the meaning of $X_1$, or is a substituent which is not fiber reactive or a fiber reactive radical of the formula (4a)

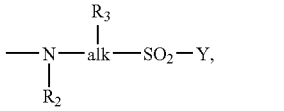

(4b)

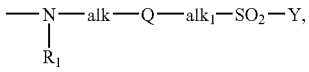

(4c)

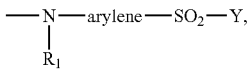

(4d)

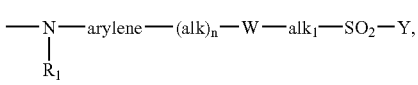

(4e)

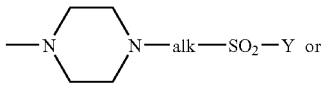

(4f)

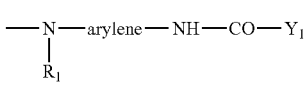

in which $R_1$, $R_{1a}$ and $R_{1b}$ independently of one another are each hydrogen or $C_1$-$C_4$alkyl, $R_2$ is hydrogen, $C_1$-$C_4$alkyl which is unsubstituted or substituted by hydroxyl, sulfo, sulfato, carboxyl or cyano or a radical

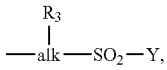

$R_3$ is hydrogen, hydroxyl, sulfo, sulfato, carboxyl, cyano, halogen, $C_1$-$C_4$alkoxycarbonyl, $C_1$-$C_4$alkanoyloxy, carbamoyl or the group $—SO_2—Y$, alk and $alk_1$ independently of one another are linear or branched $C_1$-$C_6$alkylene, arylene is a phenylene or naphthylene radical which is unsubstituted or substituted by sulfo, carboxyl, $C_1$-$C_4$alkyl, $C_1$-$C_4$alkoxy or halogen, Q is a radical —O— or $—NR_1—$, in which $R_1$ is as defined above, W is a group $—SO_2—NR_2—$, $—CONR_2—$ or $—NR_2CO—$, in which $R_2$ is as defined above, Y is vinyl or a radical $—CH_2—CH_2—U$ and U is a group which can be split off under alkaline conditions, $Y_1$ is a group $—CH(Hal)-CH_2-Hal$ or $—C(Hal)=CH_2$ and Hal is chlorine or bromine and 1 and m independently of one another are an integer from 1 to 6 and n is the number 0 or 1;

and $X_2$ is halogen or $C_1$-$C_4$alkylsulfonyl;

$X_3$ is halogen or $C_1$-$C_4$alkyl and $T_2$ is hydrogen, cyano or halogen.

4. A process according to claim 2, wherein $Z_1$, $Z_2$ and $Z_3$ are each independently of the other a radical of the formula (3a), (3c), (3d), (3e) or (3f) According to claim 3, in which Y is vinyl, β-chloroethyl or β-sulfatoethyl, Hal is bromine, $R_2$ and $R_{1a}$ are hydrogen, m is the number 2 or 3, $X_1$ is halogen, $T_1$ is $C_1$-$C_4$alkoxy, $C_1$-$C_4$alkylthio, hydroxyl, amino, N-mono- or N,N-di-$C_1$-$C_4$alkylamino which are unsubstituted or substituted in the alkyl moiety by hydroxyl, sulfato or sulfo, morpholino, phenylamino or N—$C_1$-$C_4$alkyl-N-phenylamino which are unsubstituted or substituted in the phenyl ring by sulfo, carboxyl, acetylamino, chlorine, methyl or methoxy and in which the alkyl is unsubstituted or substituted by hydroxyl, sulfo or sulfato, or naphthylamino which is unsubstituted or substituted by 1 to 3 sulfo groups, or a fiber-reactive radical of the formula (4a′)

$$—NH—(CH_2)_{2-3}—SO_2Y,$$

(4b′)

$$—NH—(CH_2)_{2-3}—O—(CH_2)_{2-3}—SO_2Y,$$

(4c′)

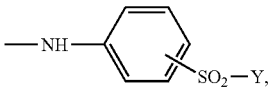

(4d′)

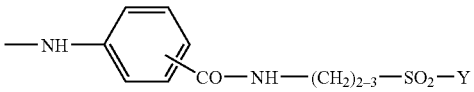

or (4f′)

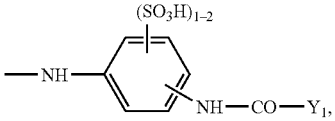

in which

Y is as defined above and $Y_1$ is a group —CH(Br)—$CH_2$—Br or —C(Br)=$CH_2$.

5. A process according to claim 2, wherein the dye of formula (1) contains 1 or 22 fiber reactive radicals $Z_1$.

6. A process according to claim 2, wherein B is a $C_2$-$C_6$alkylene radical, which may be interrupted by 1, 2 or 3 —O— members and is unsubstituted or substituted by hydroxy.

7. A process according to claim 2, wherein $G_1$ und $G_2$ are each independently of the other chlorine or fluorine.

8. A process according claim 2, wherein $A_1$, $A_2$ and $A_3$ are each independently of the other a radical of the formula (8a)

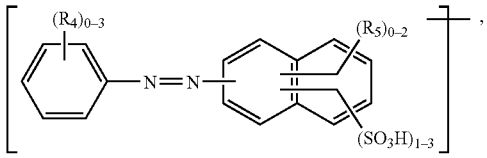

wherein $(R_4)_{0-3}$ denotes from 0 to 3 identical or different substituents selected from the group consisting of $C_1$-$C_4$alkyl, $C_1$-$C_4$alkoxy, $C_2$-$C_4$alkanoylamino, ureido, sulfamoyl, carbamoyl, sulfomethyl, halogen, nitro, cyano, trifluoromethyl, amino, hydroxy, carboxy and sulfo, $(R_5)_{0-2}$ denotes from 0 to 2 identical or different substituents from the group hydroxy, amino, N-mono-$C_1$-$C_4$alkylamino, N,N-di-$C_1$-$C_4$alkylamino, $C_2$-$C_4$alkanoylamino and benzoylamino;

(8b)

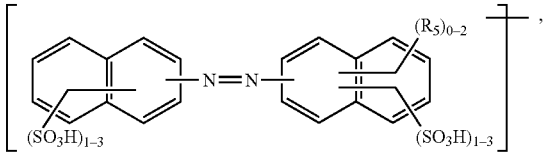

wherein $(R_5)_{0-2}$ is as defined above;

(8c)

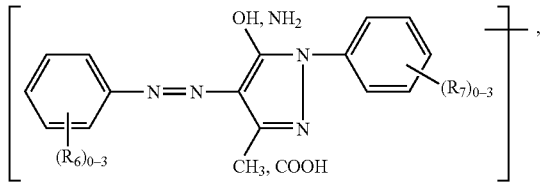

wherein $(R_6)_{0-3}$ und $(R_7)_{0-3}$ independently of the other denotes from 0 to 3 identical or different substituents selected from the group consisting of $C_1$-$C_4$alkyl, $C_1$-$C_4$alkoxy, halogen, carboxy and sulfo;

(8d)

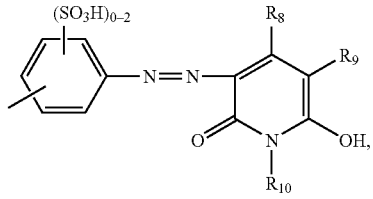

wherein $R_8$ und $R_{10}$ are each independently of the other hydrogen, $C_1$-$C_4$alkyl or phenyl, and $R_9$ hydrogen, cyano, carbamoyl or sulfomethyl;

(8e)

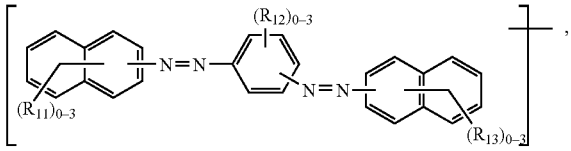

wherein $(R_{12})_{0-3}$ denotes from 0 to 3 identical or different substituents selected from the group consisting of $C_1$-$C_4$alkyl, $C_1$-$C_4$alkoxy, halogen, amino, carboxy and sulfo, and $(R_{11})_{0-3}$ and $(R_{13})_{0-3}$ independently of the other are as defined for $(R_4)_{0-3}$;

(8f)

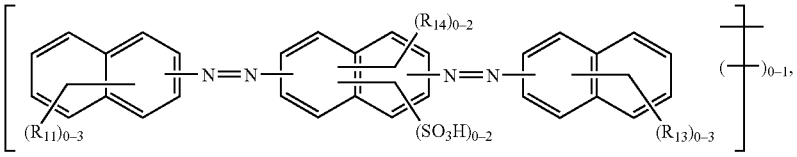

wherein $(R_{11})_{0-3}$ and $(R_{13})_{0-3}$ independently of the other are as defined above $(R_{14})_{0-2}$ denotes from 0 to 2 identical or different substituents selected from the group consisting of $C_1$-$C_4$alkyl, $C_1$-$C_4$alkoxy, halogen, carboxy, sulfo, hydroxy, amino, N-mono-$C_1$-$C_4$alkylamino, N,N-di-$C_1$-$C_4$alkylamino, $C_2$-$C_4$alkanoylamino and benzoylamino;

(9)

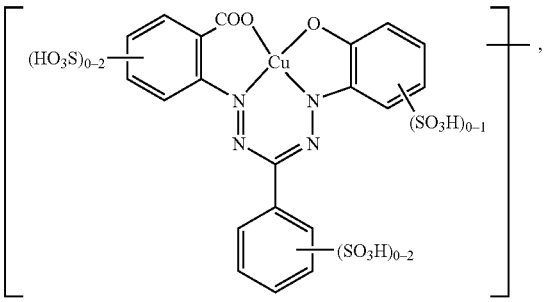

wherein the benzene nuclei do not contain any further substituents or are further substituted by $C_1$-$C_4$alkyl, $C_1$-$C_4$alkoxy, $C_1$-$C_4$alkylsulfonyl, halogen or by carboxy;

(10)

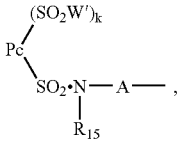

wherein

Pc is the radical of a metal phthalocyanine,

W' is —OH and/or —$NR_{16}R_{16}$' and $R_{16}$ and $R_{16}$' are each independently of the other hydrogen or $C_1$-$C_4$alkyl that is unsubstituted or substituted by hydroxy or by sulfo, $R_{15}$ is hydrogen or $C_1$-$C_4$alkyl, A is a phenylene radical that is unsubstituted or substituted by $C_1$-$C_4$alkyl, $C_1$-$C_4$alkoxy, halogen, carboxy or by sulfo or is a $C_2$-$C_6$alkylene radical and k is from 1 to 3;

(11)

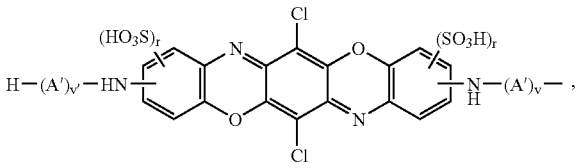

wherein

A' is a phenylene radical that is unsubstituted or substituted by $C_1$-$C_4$alkyl, $C_1$-$C_4$alkoxy, halogen, carboxy or by sulfo or is a $C_2$-$C_6$alkylene radical, r independently is the number 0, 1 or 2, and v and v' are each independently of the other the number 0 or 1; or (12)

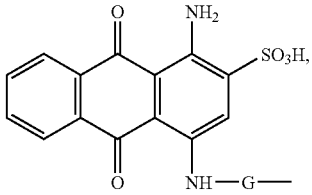

wherein

G is a phenylene radical that is unsubstituted or substituted by $C_1$-$C_4$alkyl, $C_1$-$C_4$alkoxy, halogen, carboxy or by sulfo or is a cyclohexylene, phenylenemethylene or $C_2$-$C_6$alkylene radical.

9. A process according to claim 1, wherein the viscosity of the ink is from 6 to 14 mPa·s at 25° C.

10. A process according to claim 2, wherein component (II) is dipropylene glycol or tripropylene glycol.

11. A process according to claim 1, wherein printing is performed by means of an ink-jet printing device provided with at least one ink-jet print head which comprises a nozzle layer (a) defining a plurality of ejection nozzles, an ink supply layer (b) which is formed from a porous material having a multitude of small interconnected pores so as to allow passage of ink therethrough, said ink supply layer featuring a plurality of connecting bores from the rear surface to the front surface, each of said connecting bores being aligned so as to connect between a corresponding one of said ejection nozzles and a deflection layer (c), comprising a plurality of transducers related to said connecting bores for ejecting ink droplets out through the nozzles.

12. A process according claim 1, wherein printing is performed by means of an ink-jet printing device provided with at least one ink-jet print head which comprises a nozzle layer (a) defining a plurality of ejection nozzles, an ink supply layer (b) having a front surface associated with the nozzle layer and a rear surface associated with a cavity layer (d), said ink supply layer being formed with a plurality of connecting bores from said rear surface to said front surface, each connecting bore being aligned so as to connect between a corresponding one of said ink cavities and a corresponding one of said ejection nozzles, wherein said ink supply layer additionally features (i) a pattern of ink distribution channels formed in said front surface, and (ii) at least one ink inlet bore passing from said rear surface to said front surface and configured so as to be in direct fluid communication with at least part of said pattern of ink distribution channels, said pattern of ink distribution channels and said at least one ink inlet bore together defining part of an ink flow path which passes from said rear surface through said at least one ink inlet bore to said pattern of ink distribution channels on said front surface, and through said porous material to said plurality of ink cavities, a deflection layer (c), comprising a plurality of transducers related to said connecting bores for ejecting ink droplets out through the nozzles.

13. A process according to claim 1, wherein the transducer is a piezoelectric element.

14. A process according to claim 1, wherein cellulosic fiber materials are printed.

15. The textile material pre-treated according to claim 1.

* * * * *